US008285160B2

(12) United States Patent
Ito et al.

(10) Patent No.: US 8,285,160 B2
(45) Date of Patent: Oct. 9, 2012

(54) IMAGE FORMING APPARATUS UTILIZING A CONCENTERATION RATIO OF COLORS

(75) Inventors: Takayuki Ito, Nagoya (JP); Fuminori Moro, Toyokawa (JP); Michiya Takeda, Hoi-gun (JP); Atsuhiko Shimoyama, Tahara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 331 days.

(21) Appl. No.: 12/131,656

(22) Filed: Jun. 2, 2008

(65) Prior Publication Data

US 2008/0298829 A1 Dec. 4, 2008

(30) Foreign Application Priority Data

Jun. 4, 2007 (JP) ..... 2007-147956

(51) Int. Cl.
*G03G 15/01* (2006.01)

(52) U.S. Cl. ..... 399/54

(58) Field of Classification Search ..... 399/39, 399/41, 53, 54, 85
See application file for complete search history.

(56) References Cited

U.S. PATENT DOCUMENTS

| | | | | |
|---|---|---|---|---|
| 5,089,859 | A | 2/1992 | Kusumoto et al. | |
| 5,091,789 | A | 2/1992 | Haneda et al. | |
| 6,527,366 | B1 * | 3/2003 | Byers et al. | 347/43 |
| 2002/0163570 | A1 * | 11/2002 | Phillips | 347/224 |
| 2003/0043392 | A1 * | 3/2003 | Sugimoto | 358/1.9 |

FOREIGN PATENT DOCUMENTS

| | | |
|---|---|---|
| JP | 2-306268 | 12/1990 |
| JP | 8-258332 | 10/1996 |
| JP | 9-163169 | 6/1997 |
| JP | 9-174945 | 7/1997 |
| JP | 2004-325597 | 11/2004 |
| JP | 2006-343641 | 12/2006 |

OTHER PUBLICATIONS

Machine English Translation of of patent JP09-163169 published Jun. 20, 1997.*

Japanese Office Action dated May 7, 2009 directed at counterpart application No. 2007-147956; 9 pages.

Japanese Examiner's Decision to Grant a Patent mailed Oct. 4, 2011, directed to Japanese Patent Application No. 2007-147956; 6 pages.

* cited by examiner

*Primary Examiner* — Walter L Lindsay, Jr.
*Assistant Examiner* — Billy J Lactaoen
(74) *Attorney, Agent, or Firm* — Morrison & Foerster LLP

(57) ABSTRACT

An object of the present invention is to provide an image forming apparatus which can achieve reduction in printing time, suppression of developer consumption, and implementation of silence. An image forming apparatus capable of forming a color image on an image carrier with use of developers of a plurality of different developing colors, including a plurality of developing devices respectively housing the developers of different colors, and a control section for controlling operation of the developing devices based on inputted image data, wherein the control section includes a concentration ratio recognition section for recognizing a concentration ratio of the respective colors for image data of every sheet from the image data, and controls so as to spare at least one color developer among the developers in response to the concentration ratio of respective colors recognized by the concentration ratio recognition section.

8 Claims, 18 Drawing Sheets

Fig.8

| Word, Excel STANDARD COLORS | CMYK CONCENTRATION RATIO (0-100%) | | | | CMYK RELATIVE CONCENTRATION RATIO WITH HIGHEST CONCENTRATION COLOR SET AS 100 (0-100%) | | | | [REFERENCE] RGB RATIO (0-255) | | |
|---|---|---|---|---|---|---|---|---|---|---|---|
| | C | M | Y | K | C | M | Y | K | R | G | B |
| BLACK | 75 | 68 | 67 | 90 | 83 | 76 | 74 | 100 | 0 | 0 | 0 |
| DEEP RED | 29 | 100 | 100 | 38 | 29 | 100 | 100 | 38 | 128 | 0 | 0 |
| RED | 0 | 99 | 100 | 0 | 0 | 99 | 100 | 0 | 255 | 0 | 0 |
| PINK | 27 | 82 | 0 | 0 | 33 | 100 | 0 | 0 | 255 | 0 | 255 |
| ROSE | 0 | 51 | 0 | 0 | 0 | 100 | 0 | 0 | 255 | 153 | 204 |
| BROWN | 26 | 88 | 100 | 24 | 26 | 88 | 100 | 24 | 153 | 51 | 0 |
| ORANGE | 0 | 74 | 100 | 0 | 0 | 74 | 100 | 0 | 255 | 102 | 0 |
| LIGHT ORANGE | 0 | 47 | 100 | 0 | 0 | 47 | 100 | 0 | 255 | 153 | 0 |
| GOLD | 1 | 19 | 100 | 0 | 1 | 19 | 100 | 0 | 255 | 204 | 0 |
| BEIGE | 0 | 22 | 42 | 0 | 0 | 52 | 100 | 0 | 255 | 204 | 153 |
| OLIVE | 64 | 56 | 92 | 63 | 70 | 61 | 100 | 68 | 51 | 51 | 0 |
| DEEP YELLOW | 51 | 36 | 100 | 13 | 51 | 36 | 100 | 13 | 128 | 128 | 0 |
| LIME | 45 | 0 | 100 | 0 | 45 | 0 | 100 | 0 | 153 | 204 | 0 |
| YELLOW | 6 | 0 | 96 | 0 | 6 | 0 | 100 | 0 | 255 | 255 | 0 |
| LIGHT YELLOW | 3 | 0 | 49 | 0 | 6 | 0 | 100 | 0 | 255 | 255 | 153 |
| DEEP GREEN | 80 | 51 | 89 | 66 | 90 | 57 | 100 | 74 | 0 | 51 | 0 |
| GREEN | 87 | 24 | 100 | 13 | 87 | 24 | 100 | 13 | 0 | 128 | 0 |
| SEE GREEN | 79 | 17 | 77 | 3 | 100 | 22 | 97 | 4 | 51 | 153 | 102 |
| BRIGHT GREEN | 63 | 0 | 100 | 0 | 63 | 0 | 100 | 0 | 0 | 255 | 0 |
| LIGHT GREEN | 18 | 0 | 28 | 0 | 64 | 0 | 100 | 0 | 204 | 255 | 204 |
| DEEP BLUISH GREEN | 100 | 87 | 33 | 23 | 100 | 87 | 33 | 23 | 0 | 51 | 102 |
| BLUISH GREEN | 86 | 31 | 49 | 8 | 100 | 36 | 57 | 9 | 0 | 128 | 128 |
| AQUA | 64 | 0 | 26 | 0 | 100 | 0 | 41 | 0 | 51 | 204 | 204 |
| CYAN | 52 | 0 | 13 | 0 | 100 | 0 | 25 | 0 | 0 | 255 | 255 |
| LIGHT CYAN | 16 | 0 | 3 | 0 | 100 | 0 | 19 | 0 | 204 | 255 | 255 |
| DEEP BLUE | 100 | 98 | 14 | 17 | 100 | 98 | 14 | 17 | 0 | 0 | 128 |
| BLUE | 88 | 77 | 0 | 0 | 100 | 88 | 0 | 0 | 0 | 0 | 255 |
| LIGHT BLUE | 78 | 62 | 0 | 0 | 100 | 79 | 0 | 0 | 51 | 102 | 255 |
| SKY BLUE | 63 | 0 | 0 | 0 | 100 | 0 | 0 | 0 | 0 | 204 | 255 |
| PALE BLUE | 35 | 10 | 0 | 0 | 100 | 29 | 0 | 0 | 153 | 204 | 255 |
| INDIGO | 96 | 95 | 0 | 0 | 100 | 99 | 0 | 0 | 51 | 51 | 153 |
| BLUE GRAY | 69 | 64 | 16 | 1 | 100 | 93 | 23 | 1 | 102 | 102 | 153 |
| PURPLE | 61 | 100 | 14 | 3 | 61 | 100 | 14 | 3 | 128 | 0 | 128 |
| PLUM | 38 | 93 | 36 | 10 | 41 | 100 | 39 | 11 | 153 | 51 | 102 |
| LAVENDER | 27 | 41 | 0 | 0 | 66 | 100 | 0 | 0 | 204 | 153 | 255 |
| 80% GRAY | 69 | 63 | 62 | 58 | 100 | 91 | 90 | 84 | 51 | 51 | 51 |
| 50% GRAY | 52 | 43 | 43 | 8 | 100 | 83 | 83 | 15 | 128 | 128 | 128 |
| 40% GRAY | 44 | 36 | 36 | 1 | 100 | 82 | 82 | 2 | 150 | 150 | 150 |
| 25% GRAY | 25 | 20 | 20 | 0 | 100 | 80 | 80 | 0 | 192 | 192 | 192 |
| WHITE | 0 | 0 | 0 | 0 | 0 | 0 | 0 | 0 | 255 | 255 | 255 |

RELATIVE CONCENTRATION RATIO OF 40% OR LESS

| | (1) | (2) | (3) |
|---|---|---|---|
| C | 0 | 0 | 17 |
| M | 75 | 90 | 92 |
| Y | 11 | 0 | 0 |
| K | 0 | 0 | 0 |

| | (4) | (5) | (6) |
|---|---|---|---|
| C | 0 | 0 | 13 |
| M | 65 | 99 | 98 |
| Y | 37 | 37 | 0 |
| K | 0 | 0 | 0 |

| | (7) | (8) | (9) |
|---|---|---|---|
| C | 0 | 0 | 17 |
| M | 74 | 83 | 100 |
| Y | 100 | 65 | 36 |
| K | 0 | 0 | 1 |

| | (10) | (11) | (12) |
|---|---|---|---|
| C | 0 | 0 | 13 |
| M | 92 | 99 | 100 |
| Y | 100 | 100 | 100 |
| K | 0 | 0 | 4 |

YMCK USE RANGE

| | |
|---|---|
| C | 0~17 |
| M | 65~100 |
| Y | 36~100 |
| K | 0~4 |

<CYAN MONOCHROME MODE>

| | (1) | (2) | (3) | (4) |
|---|---|---|---|---|
| C | 86 | 91 | 88 | 83 |
| M | 61 | 81 | 77 | 74 |
| Y | 0 | 0 | 0 | 0 |
| K | 0 | 0 | 0 | 0 |

| | (5) | (6) | (7) | (8) |
|---|---|---|---|---|
| C | 70 | 81 | 78 | 86 |
| M | 34 | 61 | 62 | 81 |
| Y | 0 | 0 | 0 | 0 |
| K | 0 | 0 | 0 | 0 |

| | (9) | (10) | (11) | (12) |
|---|---|---|---|---|
| C | 67 | 57 | 70 | 75 |
| M | 35 | 37 | 64 | 78 |
| Y | 0 | 0 | 0 | 0 |
| K | 0 | 0 | 0 | 0 |

YMCK USE RANGE

| | |
|---|---|
| C | 57~91 |
| M | 34~81 |
| Y | 0 |
| K | 0 |

IMAGE FORMING APPARATUS UTILIZING A CONCENTERATION RATIO OF COLORS

RELATED APPLICATION

This application is based on Japanese Patent Application No. 2007-147956, the content of which is incorporated herein by reference.

BACKGROUND OF THE INVENTION

The present invention relates to an image forming apparatus which can form color images using developers (developing agents) of a plurality of different colors.

Conventionally, image forming apparatuses have been known which sequentially superimpose toner images of four colors on a belt with use of one photoconductor and collectively retransfer these toner images to a sheet to form color images. In color printing, the apparatuses of such configuration need time to print one sheet since development is performed by switching developing devices so that the developing devices face the photoconductor. However, in monochrome printing, the apparatuses can achieve printing speed similar to that of monochrome printers since the switchover is not necessary, and further since requiring only one photoconductor contributes to low cost, the apparatuses are highly advantageous for users who usually print monochrome images.

Now, in the business field, images which are not in full color but not in monochrome either are often printed. These printing includes, for example, accent colors used in a part of text images, and identification colors such as for use in color graphs inserted into a part of text data images. Such images are mainly used for identification by color and do not require faithful reproduction of delicate colors such as seen in photography data. However, even in such cases, color regions are subjected to image formation process performed by using all four colors of developers. Consequently, the image formation operation of one sheet takes a long time, which in turn causes problems such as wasteful consumption or exhaustion of consumable goods including developers and photoconductors.

Moreover, even when the consumption of the developer of a certain specific color is smaller than the developers of other colors, the image formation process with the developer of the specific color is still performed, and so users may find the operating sound generated at the time of the image formation process unpleasant.

Accordingly, a technique to solve the above-mentioned problem has been proposed, for example, in JP 9-163169A, in which a developing device dispensed from image formation is generated by approximating all the colors reproduced by the image forming apparatus to a total of six colors which are produced from one or two toners.

However, the above-mentioned technique has a defect, that is, for example, those close to red color are all approximated to the same red color, with a result that a graph which should essentially be reproduced in different colors is expressed in the same color, making it impossible to identify the difference.

SUMMARY OF THE INVENTION

Accordingly, the first object of the present invention is to provide an image forming apparatus which can achieve further reduction in printing time, suppression of developer consumption, and implementation of silence when color images other than monochrome images are reproduced. The second object of the present invention is to provide an image forming apparatus which keeps the number of identifiable colors from decreasing compared with the conventional apparatuses at the time of achieving the first object.

In order to accomplish the objects, there is provided an image forming apparatus of the present invention capable of forming a color image on an image carrier with use of developers of a plurality of different developing colors, including a plurality of developing devices respectively housing the developers of different colors, a control section for controlling operation of the developing devices based on inputted image data, wherein the control section includes a concentration ratio recognition section for recognizing a concentration ratio of the respective colors for image data of every sheet from the image data, and controls so as to spare at least one color among the developers in response to the concentration ratio of respective colors recognized by the concentration ratio recognition section.

According to the image forming apparatus of the present invention, control over the developer consumption and reduction in sound level can be achieved by controlling so that at least one color may be spared, i.e., by preventing operation of at least one developing device associated with the color which is spared.

Also in the present invention, in the case of a so-called four cycle-type image forming apparatus having a driving section for rotatably driving the developing unit in such a way that the developing devices may be moved to a developing position facing the image carrier, the developing unit is rotated in the normal or reverse direction so as to minimize the moving distance to the developing position for a developing device, which is to be used in the next development step, so that it becomes possible to reduce the time taken for image formation of one sheet with utmost efficiently, as well as to minimize the number of collisions between a developer carrier of the developing device and the image carrier so as to achieve silence.

BRIEF DESCRIPTION OF THE DRAWINGS

The present invention will be further described with reference to the accompanying drawings wherein like reference numerals refer to like parts in the several views, and wherein:

FIG. 8 is a table showing CMYK concentration ratio and CMYK relative concentration ratio of standard colors for use in Word and Excel;

DETAILED DESCRIPTION OF THE PREFERRED EMBODIMENTS

First Embodiment

Figure 1:
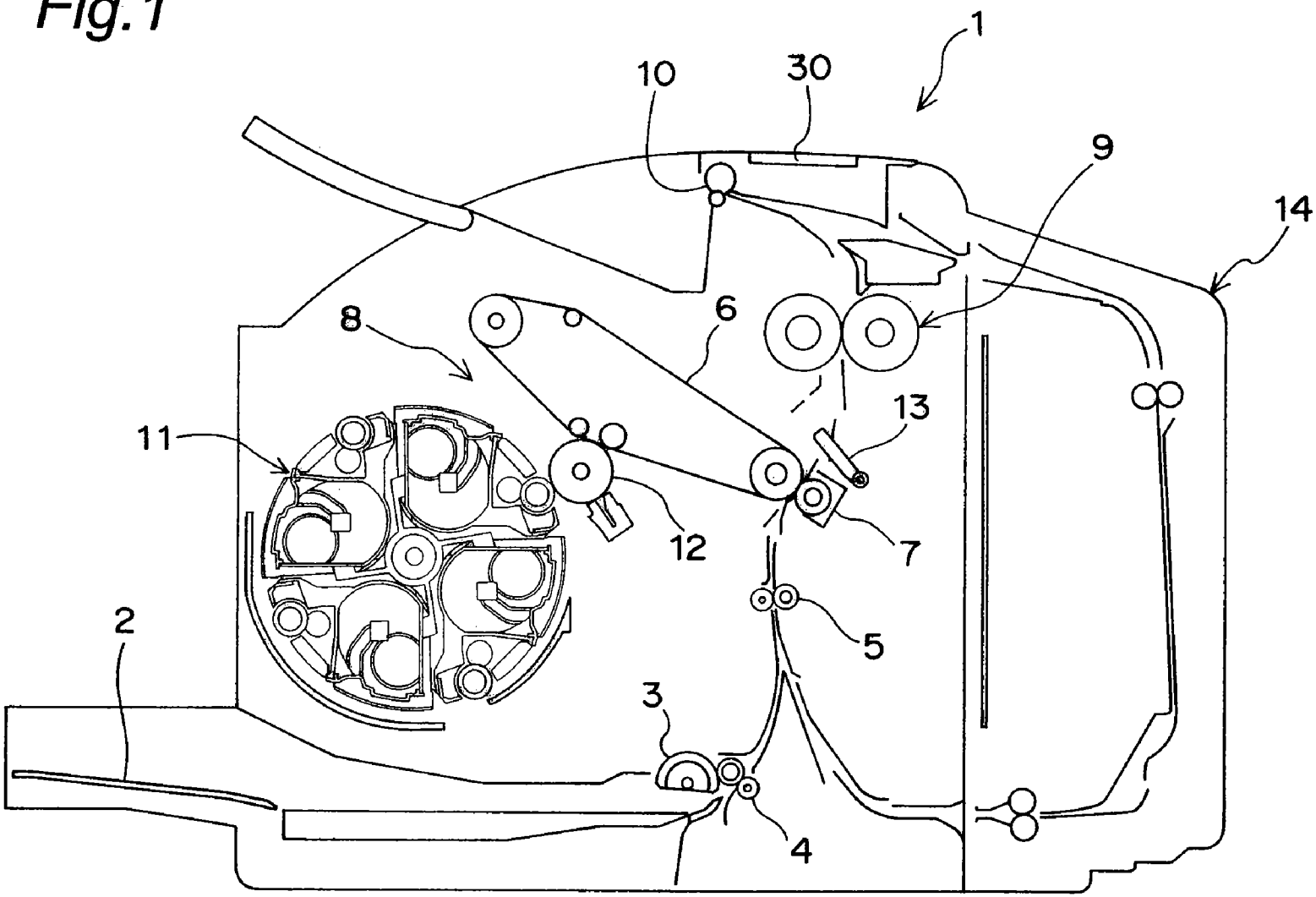
FIG. 1 is a schematic overall structure view of an image forming apparatus in each embodiment of the present invention.

A so-called four cycle-type image forming apparatus 1 which is a first embodiment of the present invention is shown in FIG. 1. In the image forming apparatus 1, recording paper is fed to a paper feed tray 2 where a feed roller 3 takes out the recording paper one at a time, and then a first conveying roller 4 and a second conveying roller 5 send the recording paper to between a transfer belt 6 and a transfer roller 7. A toner image is formed on the transfer belt 6 by an imaging section 8, and the toner image is transferred onto the recording paper by electrostatic force of the transfer roller 7. Then the recording paper is heated by a fixing roller 9 to fix the toner image before being discharged out of the apparatus by a discharge roller 10. The imaging section 8 can form a toner image from four different developing color toners (developers), Y (yellow), M (magenta), C (cyan), and K (black), and has a developing unit 11 and a photoconductor (image carrier) 12. The image forming apparatus 1 has a sheet tension sensor 13 which detects the tension level of the recording paper set between the transfer roller 7 and the fixing roller 9. Further, in order to form a toner image on both sides, the image forming apparatus 1 includes a double-side printing unit 14 which turns the recording paper over and sends it to the second conveying roller 5.

The image forming apparatus 1 also includes a control panel 30, which constitutes a selection section and a confirmation section, on the upper face of the apparatus main frame. The control panel 30 is constituted from, for example, an color liquid crystal touch panel which allows setting of image printing conditions (later-described accent color mode, magenta monochrome mode, cyan monochrome mode, combination mode, etc.) and prior indication of output images. It is to be noted that selection of the accent mode and the like may be conducted in, for example, an external device, such as personal computers, which outputs image data to the image forming apparatus.

Figure 2:
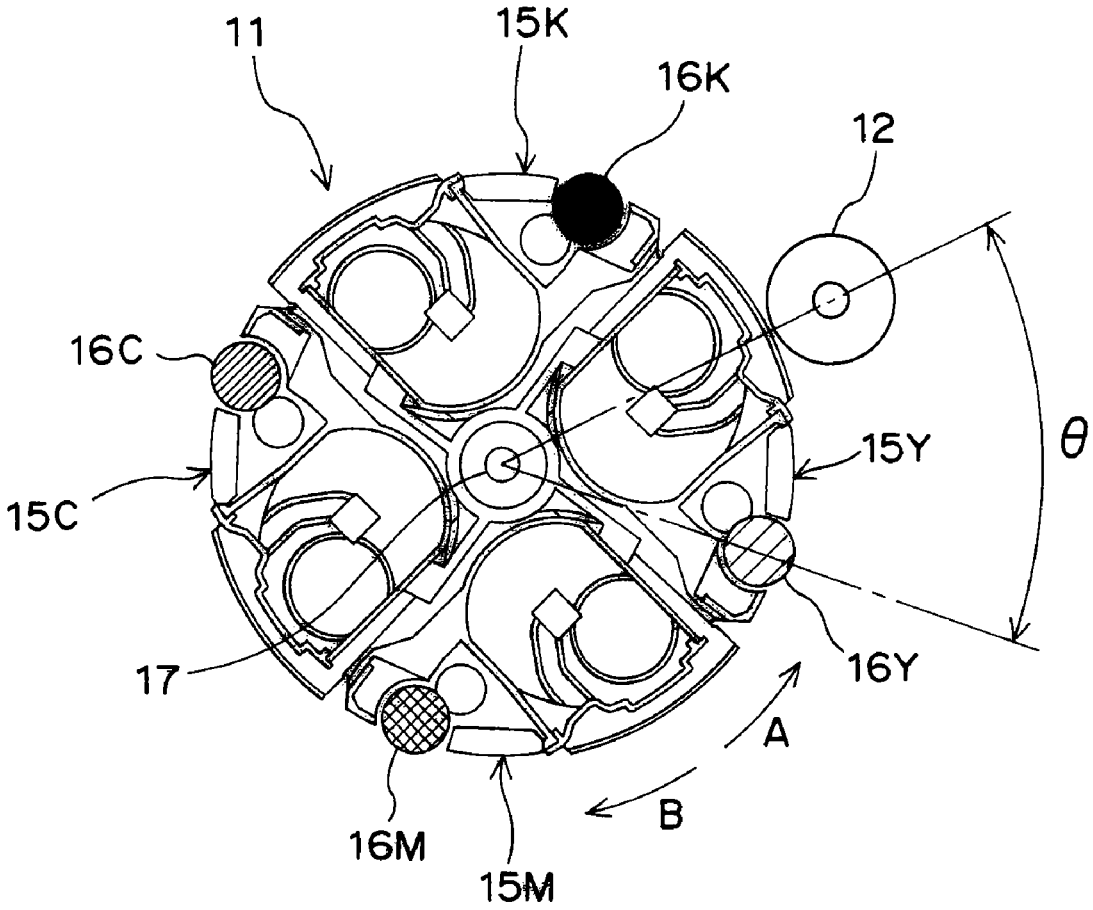
FIG. 2 is a side view showing a developing unit in a standby position and a photoconductor.

The developing unit 11 and the photoconductor 12 are shown in FIG. 2 in detail. An electrostatic latent image is formed on the surface of the photoconductor 12 by unshown charger and exposure device. The developing unit 11 is a rotatable drum-type unit having developing devices 15Y, 15M, 15C and 15K for respectively housing toners of four colors, Y, M, C and K, which are placed every 90 degrees around a revolving shaft 17, so that the toners of respective developing colors are fed to the electrostatic latent image on the photoconductor 12 to form (develop) a toner image. The respective developing devices 15Y, 15M, 15C and 15K have developing rollers (developer carriers) 16Y, 16M, 16C and 16K which can come into contact with the photoconductor 12 at a rotation position of the developing unit 11, so that the toners retained on the surfaces of the developing rollers 16Y, 16M, 16C and 16K in a uniform laminar state are attached to the electrostatic latent image on the photoconductor 12.

The development unit 11 is rotated normally or reversely in an illustrated arrow A or B direction, in order to serially form images of respective developing colors, Y, M, C and K on the photoconductor 12 during image formation. FIG. 2 shows the developing unit 11 in a standby position when the image forming apparatus 1 is not in image forming operation. In the standby position, the developing unit 11 stays in a position which is behind the position where a black developing roller 16K comes into contact with the photoconductor 12 by theta degrees (e.g., 45 degrees) in the rotation direction during image formation shown by arrow A.

Figure 3:
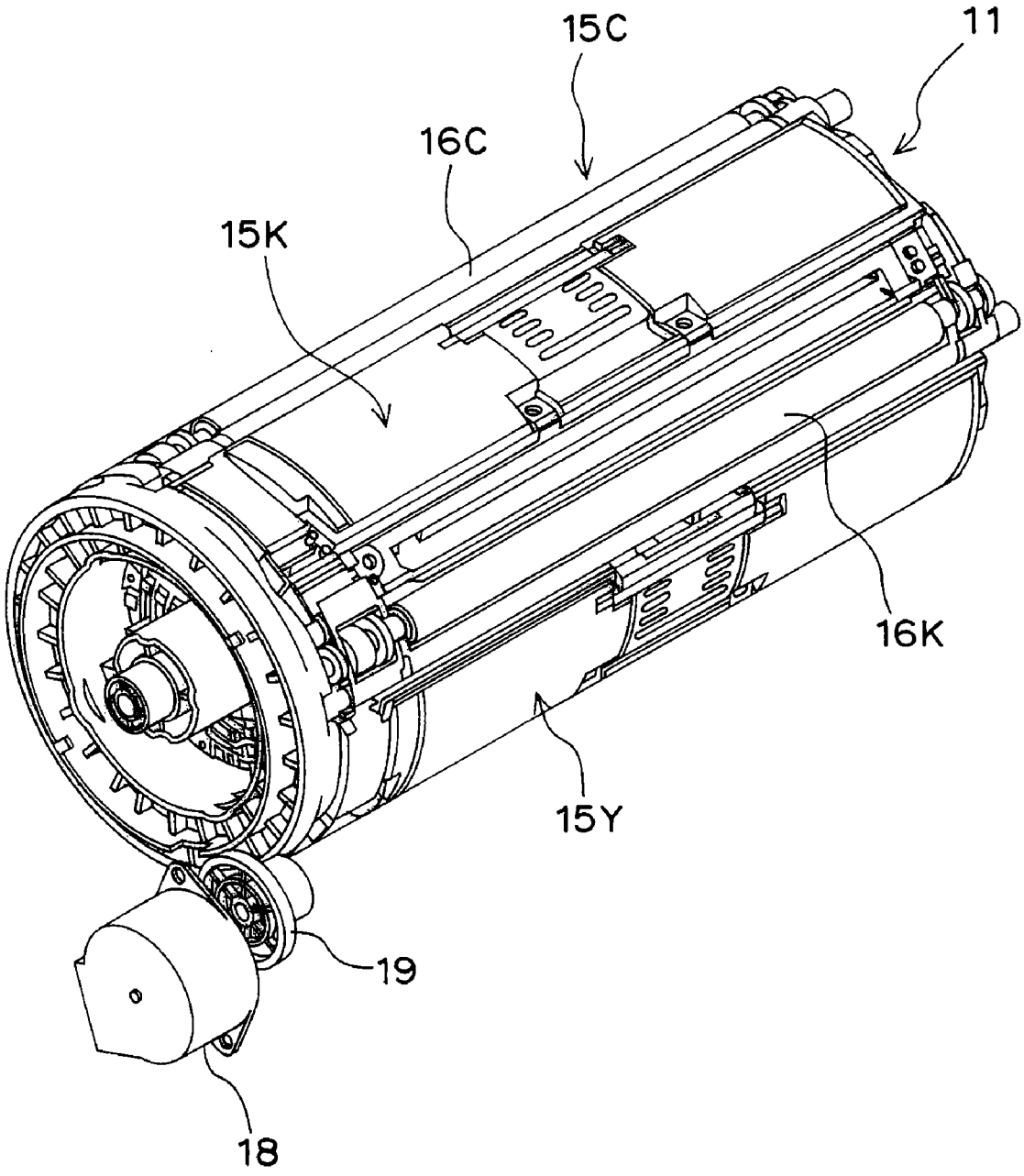
FIG. 3 is a perspective view showing a developing unit and a developing unit drive motor.
Figure 4:
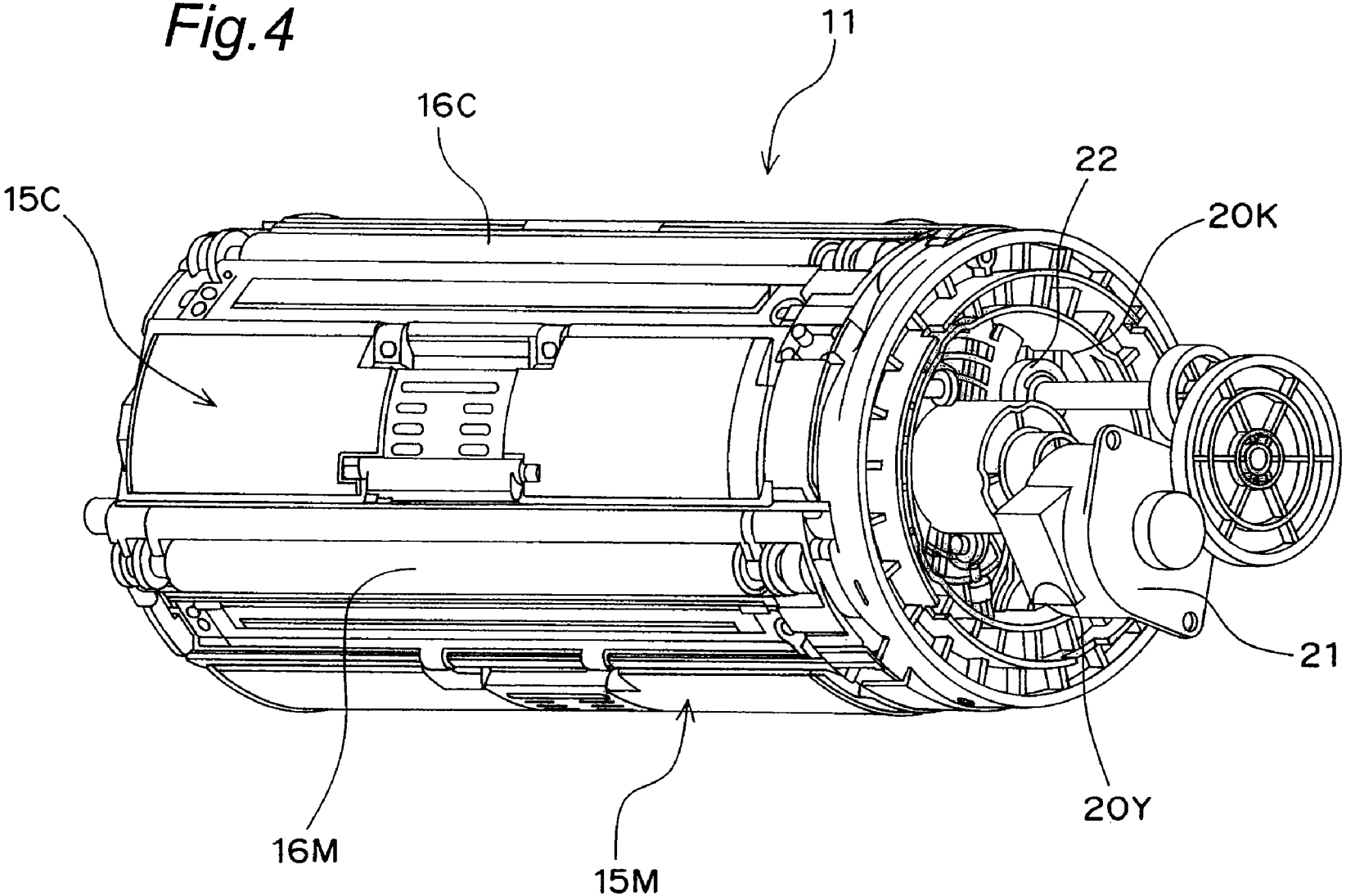
FIG. 4 is a perspective view showing a developing unit and a developing roller drive motor.

The perspective outside view of the developing unit 11 is shown in FIG. 3. The developing unit 11 is engaged with a developing unit driving gear 19, which is driven by a developing unit drive motor (driving section) 18, at one end so that the developing unit 11 is driven normally or reversely by the developing unit drive motor 18 in the arrow A or B direction in FIG. 2. The developing unit 11 has developing roller driving gears 20Y, 20M (unshown), 20C (unshown), and 20K which rotate developing rollers 16Y, 16M, 16C and 16K, respectively, as shown in FIG. 4. Further, the imaging section 8 of the image forming apparatus 1 has a primary driving gear 22 driven by a developing roller drive motor 21 and a developing roller drive motor 21 which are secured independently of the developing unit 11, so that when one of the developing roller driving gears 20Y, 20M, 20C and 20K gears with the primary driving gear 22 at the rotation position of the developing unit 11, one of the developing rollers 16Y, 16M, 16C and 16K is rotated by the developing roller drive motor 21.

Figure 5:
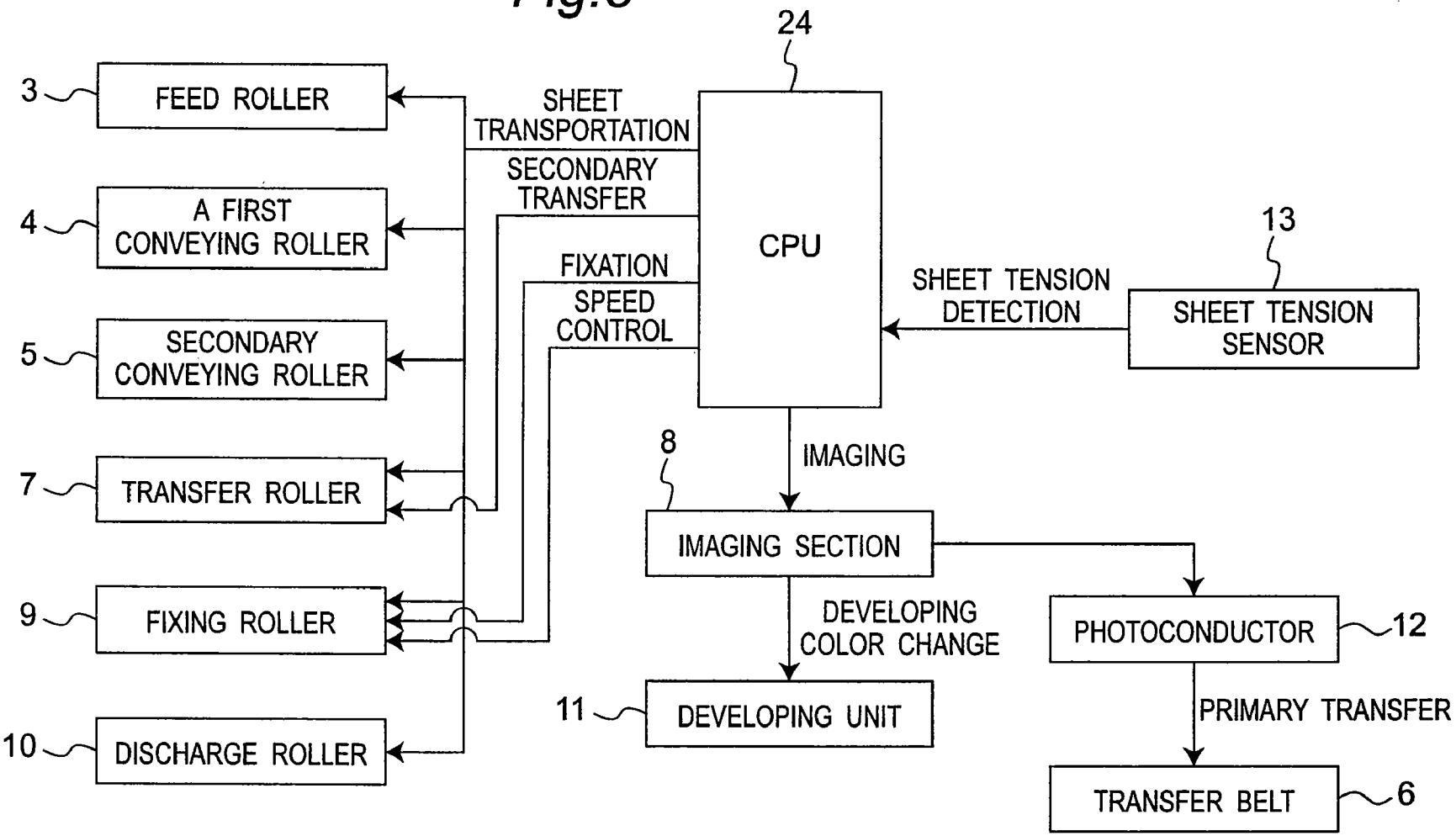
FIG. 5 is a block diagram showing a control system of an image forming apparatus.

FIG. 5 shows the association of respective components of the image forming apparatus 1 in terms of control. The entire operation of the image forming apparatus 1 is controlled by a CPU (control section, determination section, and calculation section) 24. The CPU 24 emits a sheet transportation command signal to a feed roller 3, a first conveying roller 4, a second conveying roller 5, a transfer roller 7, a fixing roller 9 and a discharge roller 10. The CPU 24 also emits a secondary transfer command signal for bringing the transfer roller 7 into tight contact with the transfer belt 6 and a fixation command signal which instructs the fixing roller 9 to maintain predetermined temperature. The sheet tension sensor 13 detects the tension level of the recording paper set between the transfer roller 7 and the fixing roller 9, and outputs it to the CPU 24. The CPU 24 controls the rotational speed of the fixing roller 9 in order to adjust the recording paper so as to provide suitable tension level. The CPU 24 instructs the imaging section 8 to form a toner image in time with transportation of the recording paper. The imaging section 8 rotates the developing unit 11 where necessary, forms toner images of predetermined developing colors on the photoconductor 12, and primarily transfers the toner images from the photoconductor 12 to the transfer belt 6.

Figure 6:
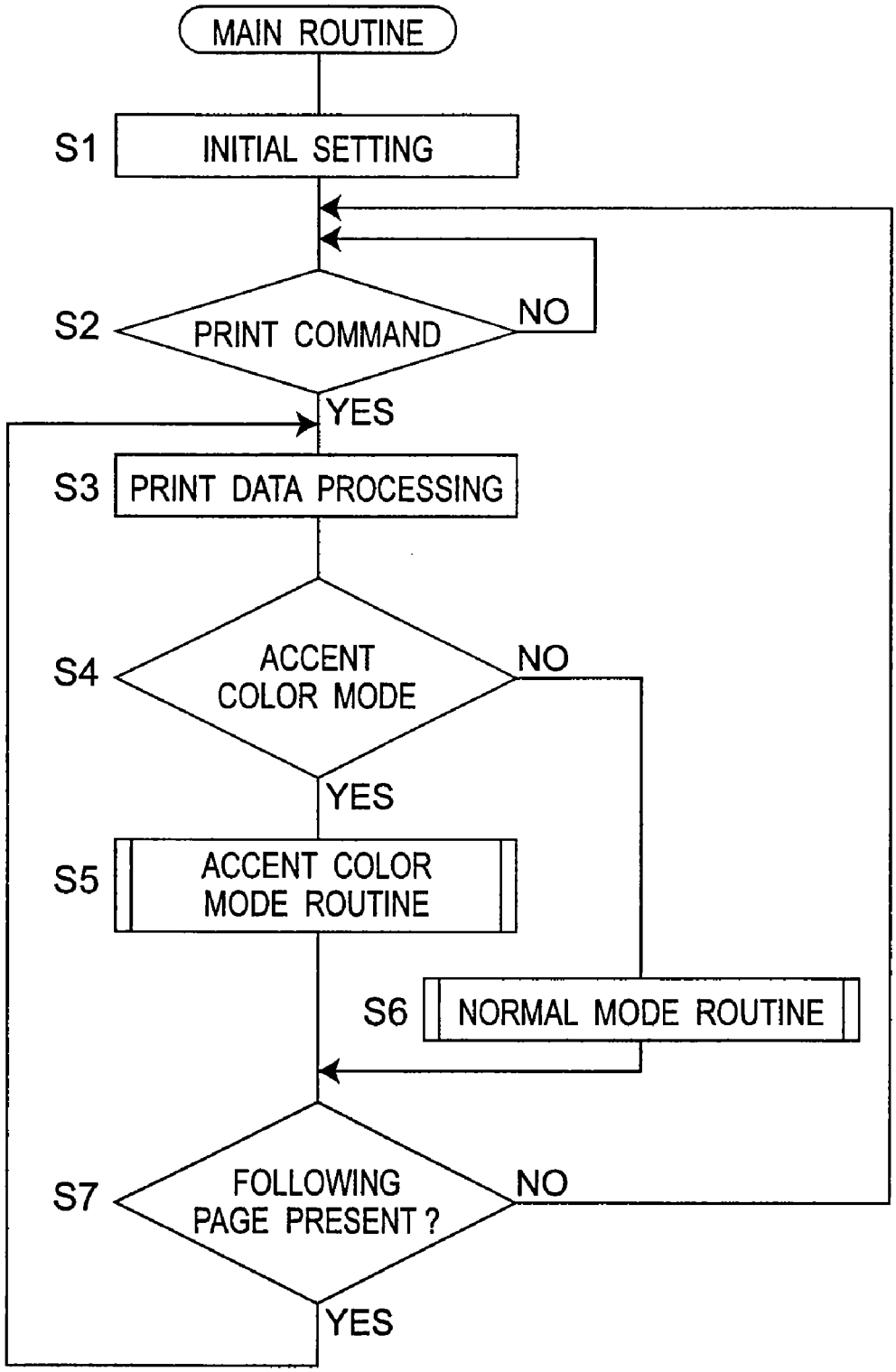
FIG. 6 is a flow chart showing a main routine in a CPU.

Description is now given of the control performed by the CPU. FIG. 6 is a flow chart showing the flow of a main routine, whereas FIG. 7 is a flow chart showing the flow of a normal mode routine in FIG. 6.

As shown in FIG. 6, at turn on, first, initial setting, such as warm-up operation and image stabilization control, is performed (step S1), and then the apparatus is in standby until a print command is issued (step S2). For example, upon reception of a print command and image data to be printed (denoted as "print data" in FIG. 6 as well as in other drawings) from an external device such as personal computers, the image data is expanded to respective color data sets corresponding to Y, M, C and K (step S3). Then, it is determined whether or not an accent color mode is selected with respect to the image data (step S4). If the accent color mode is selected, an accent color mode routine is performed (step S5), whereas if the accent color mode is not selected, then a normal mode routine is performed (step S6). Thus, processing of the image data for the first page is completed, and then it is determined whether or not a following page which should be processed in succession is present (step S7). If the following page is present, then the procedure returns to the image data processing of the step S3, whereas if no following page is present, then the apparatus returns to a print command waiting state of the step S2.

Figure 7:
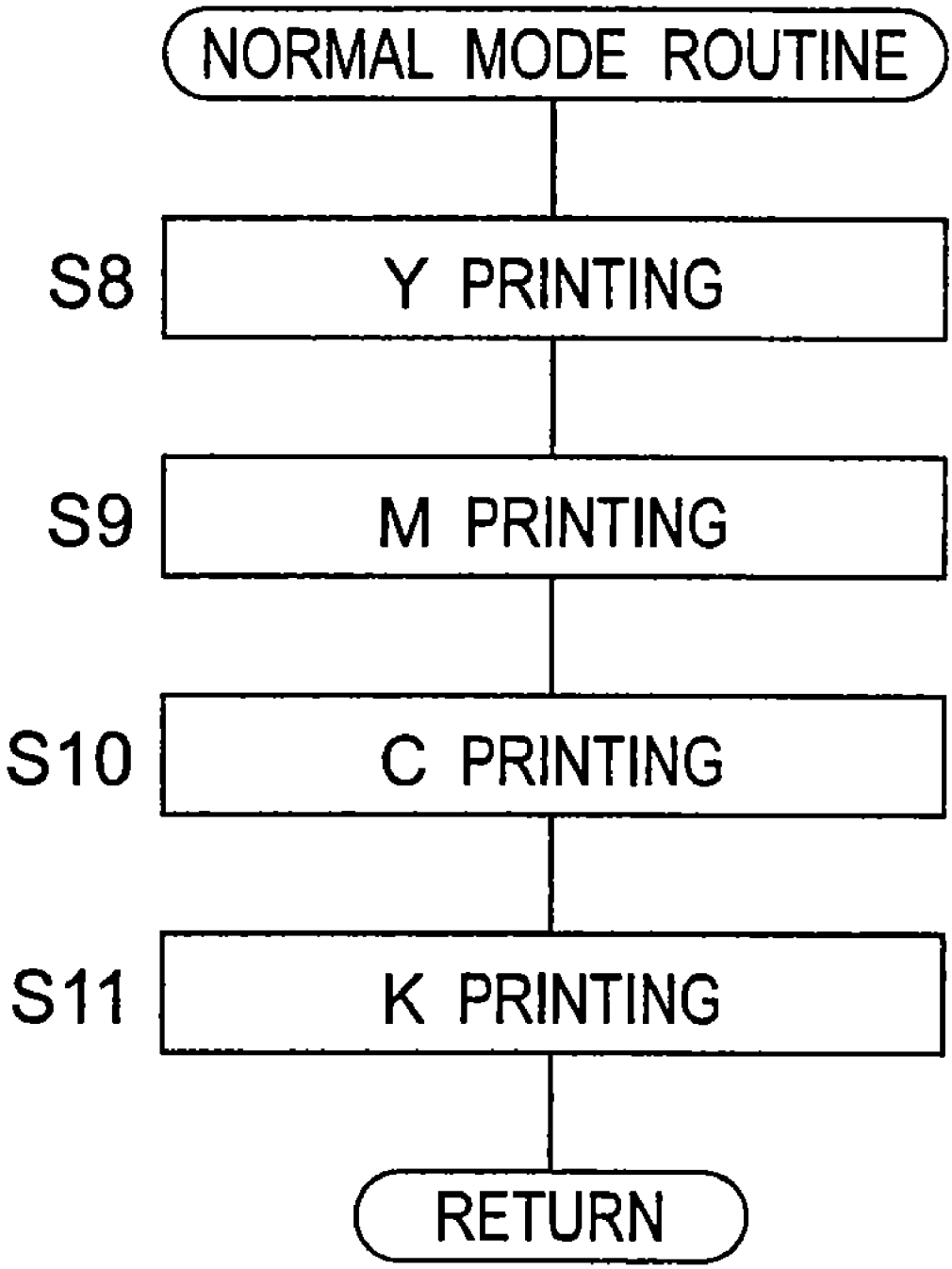
FIG. 7 is a flow chart showing a normal mode routine in FIG. 6.

In the normal mode routine as shown in FIG. 7, first, the developing unit 11 is rotated in the direction of arrow A by only 45 degrees from a standby position shown in FIG. 2, and is stopped in a developing position where a developing roller 16Y of a developing device 15Y faces the photoconductor 12. This results in formation of a yellow image on the photoconductor 12 by the developing device 15Y (step S8). Then, the developing unit 11 is sequentially rotated and stopped every 90 degrees in the direction of arrow A so that a magenta image, a cyan image, and a black image are sequentially formed on the photoconductor 12 by the respective developing devices 15M, 15C and 15K which have reached the developing position (step S9-S11). The toner images formed on the photoconductor 12 are sequentially transferred on top of each other onto the transfer belt 6, and then are collectively subjected to secondary transfer onto a sheet. Once image formation processing of all four colors is completed, the developing unit 11 is returned to the standby position, and the processing is ended.

Next, before the accent color mode routine will be described in concrete, brief description is given to the control over image formation without using one or two developing colors based on image data containing a portion carrying an accent color. Here in the accent color mode, the toner amount needed per dot when YMCK colors, or reference colors are printed in one color is set as 100%, and a ratio of the respective toner amounts of YMCK colors used per dot to express the color of a certain output image is defined as a YMCK concentration ratio. Specific examples of the accent colors referred herein include images created by Word, Excel, Power Point (registered trademark) and the like, which are the software by U.S. Microsoft Corp., in which a part of texts is emphasized by a color different from the color of other parts (black), such as deep red, and in which lines representing data of a graph view inserted in a part of the image are drawn in a color different from the color of other parts (black), such as brown.

There are 40 kinds of standard colors generally used as accent colors in the Word and the like, including, as shown in the table in FIG. 8, black, deep red, red, pink, rose, brown, orange, light orange, gold, beige, olive, deep yellow, lime, yellow, light yellow, deep green, green, sea green, bright green, light green, deep bluish green, bluish green, aqua, cyan, light cyan, deep blue, blue, light blue, sky blue, pale blue, indigo, blue gray, purple, plum, lavender, 80% gray, 50% gray, 40% gray, 25% gray, and white. Corresponding to these respective colors, concentration ratios of YMCK colors and relative concentration ratios of YMCK colors with a highest concentration color set as 100 are shown in a table of FIG. 8. In this relative concentration ratio, sections shown with slanting lines are those having a relative concentration ratio of 40% or less. There are 8 kinds of colors, in which one out of four YMCK colors has a relative concentration ratio of 40% or less, and these colors include pink, yellow, light yellow, cyan, light cyan, pale blue, 50% gray, and 40% gray. There are 12 kinds of colors in which two out of four YMCK colors have a relative concentration ratio of 40% or less, and these colors include deep red, brown, gold, deep yellow, green, sea green, deep bluish green, bluish green, deep blue, blue gray, purple, and plum. These 8 colors and 12 colors add up to 20 colors, which is equivalent to half the total 40 colors.

As for these 20 kinds of colors, even when development with developing colors having a relative concentration ratio of 40% or less are omitted or excluded and approximate colors are substituted for these developing colors, resultant output images provide mostly the same colors in appearance as those users desire, thereby implementing satisfactory color level.

Now, Table 1 below shows typical examples of 8 kinds among the 20 kinds outputted in the standard colors and in the colors substituting for one or two developing colors having an equivalent concentration percentage of 40% or less, which have been confirmed to have satisfactory color level by visual inspection. In Table 1, each YMCK numeric value expresses the CMYK concentration ratio on the left-hand side in the table of FIG. 8.

TABLE 1

| | Standard colors | Substitute colors |
|---|---|---|
| Pink | C27, M82, Y0, K0 | C0, M82, Y0, K0 |
| Yellow | C6, M0, Y96, K0 | C0, M0, Y96, K0 |
| Light yellow | C3, M0, Y46, K0 | C0, M0, Y49, K0 |
| Green | C87, M24, Y100, K13 | C87, M24, Y100, K0 |
| bluish green | C86, M31, Y49, K8 | C86, M31, Y49, K0 |
| Cyan | C52, M0, Y13, K0 | C52, M0, Y0, K0 |
| Light cyan | C16, M0, Y3, K0 | C16, M0, Y0, K0 |
| Purple | C61, M100, Y14, K3 | C61, M100, Y14, K0 |

Therefore, regarding the 20 kinds of colors, sparing the development operation with at least one developing color having an equivalent concentration percentage of 40% or less, i.e., preventing the corresponding developing device from stopping at the developing position and operating therein make it possible to suppress toner consumption, as well as to shorten output time and to reduce noise level due to the decrease of development operation.

Although description has been given in the assumption that the relative concentration ratio for allowing the development operation to be omitted should be 40%, this is merely an example and the specific numeric value can be selected or changed on a control panel 30 or with a personal computer as users desire. Moreover, an output image in the case of omitting development with one or two developing colors may be displayed on the control panel 30 for confirmation before printing. In this way, it becomes possible to modify the setting before outputting if an output image greatly varies from the color output that a user expected.

Figure 9:
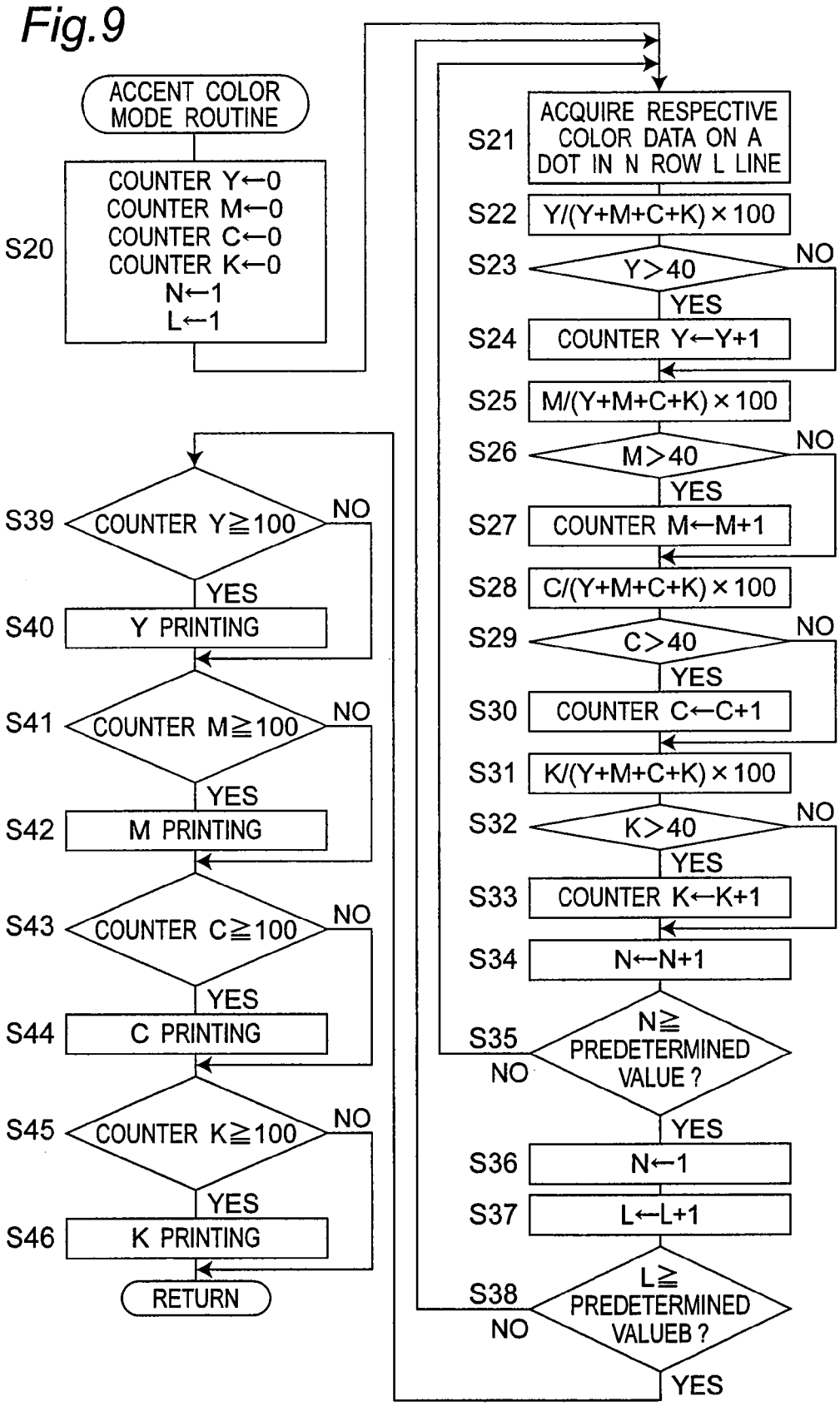
FIG. 9 is a flow chart showing an accent color mode routine in FIG. 6.

Description is now given of the flow of the accent color mode routine in detail with reference to FIG. 9. First, a counter Y, a counter M, a counter C, and a counter K which count the dot number of respective colors are respectively set to 0, while a value N and a value L in N row L line concerning all the dots formed in the whole image formation region are each set to 1 (step S20).

Then, respective color data of a dot in N row L line (i.e., herein the first row first line) is acquired from YMCK data sets obtained by the expansion processing of the step S3 (step S21). A relative concentration ratio of Y is calculated from the acquired respective color data (step S22). Then, it is determined whether or not the relative concentration ratio of Y is larger than 40% (step S23). If the relative concentration ratio of Y is larger than 40%, the counter Y increases the count value by only 1 (step S24), whereas if the relative concentration ratio of Y is 40% or less, the count value is not increased.

Hereafter, in the similar way, a relative concentration ratio of M is calculated (step S25), and it is determined whether or not the relative concentration ratio of M is larger than 40% (step S26). If the relative concentration ratio of M is larger than 40%, the counter M increases the count value by only 1 (step S27), whereas if the relative concentration ratio of M is 40% or less, the count value is not increased. In the same manner, a relative concentration ratio of C is calculated (step S28), and it is determined whether or not the relative concentration ratio of C is larger than 40% (step S29). If the relative concentration ratio of C is larger than 40%, the counter C increases the count value by only 1 (step S30), whereas if the relative concentration ratio of C is 40% or less, the count value is not increased. Further in the same manner, a relative concentration ratio of K is calculated (step S31), and it is determined whether or not the relative concentration ratio of K is larger than 40% (step S32). If the relative concentration ratio of K is larger than 40%, the counter K increases the count value by only 1 (step S33), whereas if the relative concentration ratio of K is 40% or less, the count value is not increased.

Next, the counter value N is increased by only 1 (step S34), and it is determined whether or not the value N is a predetermined value or more (step S35). The predetermined value herein refers to the number of dot rows determined in association with the whole image formation region set up for the recording paper. If it is determined that the value N is smaller than the predetermined value, the processing of the steps S21 to S34 is repeatedly performed on all the dots after the second dot in L line (herein the first line). If it is determined that the value N is the predetermined value or more, then the value N is reset to 1 (step S36), the value L is increased by only 1 (step S37), and it is determined whether or not the value L is the predetermined value or more (step S38). The predetermined value herein refers to the number of dot lines determined in association with the whole image formation region set up for the recording paper. If it is determined that the value L is smaller than the predetermined value, the processing of the steps S21 to S37 is repeatedly performed, by which the respective counters Y, M, and C and K count the number of the dots whose YMCK relative concentration ratio is 40% or less among all the dots in N row L line in an image for one sheet.

Then it is determined whether or not the counted value of the counter Y is 100 or more (step S39), and if the value is 100 or more, then Y printing is performed (step S40), whereas if the value is smaller than 100, then Y printing is omitted. Herein, while the value "100" is set up in consideration of the influence of errors which may be included in each of dot data and the like, it should be naturally understood that the value is not limited to this numeric value, and may be changed suitably.

Hereafter, it is determined in the similar way whether or not the counted values of the counters M, C, and K are 100 or more (step S41, S43, S45). If the value is 100 or more, M printing, C printing, and K printing are performed (step S42, S44, S46), whereas if the value is smaller than 100, M printing, C printing, and K printing are omitted.

Thus, according to the image forming apparatus 1 of the present embodiment, when the accent color mode is selected and when at least any one of the relative concentration ratios of YMCK in the accent color is 40% or less, image formation is controlled so that the toner of the color whose relative concentration ratio is 40% or less is not used. That is, it becomes possible to suppress toner consumption and reduce a sound level by sparing the operation of the developing devices 15Y, 15M, 15C, and 15K corresponding to developing colors which are not used.

Moreover, in the so-called four cycle-type image forming apparatus 1, omitting the development with at least 1 color of toner as mentioned above means that a developing device which is dispensed from development can pass without stopping at the developing position, so that the time necessary for outputting an image of one sheet can be shortened.

Second Embodiment

Description is now given of an image forming apparatus according to a second embodiment of the present invention. Since the second embodiment is similar in structure to the image forming apparatus 1 of the first embodiment except control by the CPU 24, description below will be dedicated to the different control.

The CPU 24 in the image forming apparatus according to the second embodiment is capable of executing a magenta monochrome mode. In the magenta monochrome mode, when an accent color is included in a part of image data for one sheet for example, image formation of an accent color section is performed only with a magenta toner if a respective color concentration ratio of the accent color is in the numeric value range of C:0 to 17%, M:65 to 100%, Y:36 to 100%, and K:0 to 4%.

Figure 10:
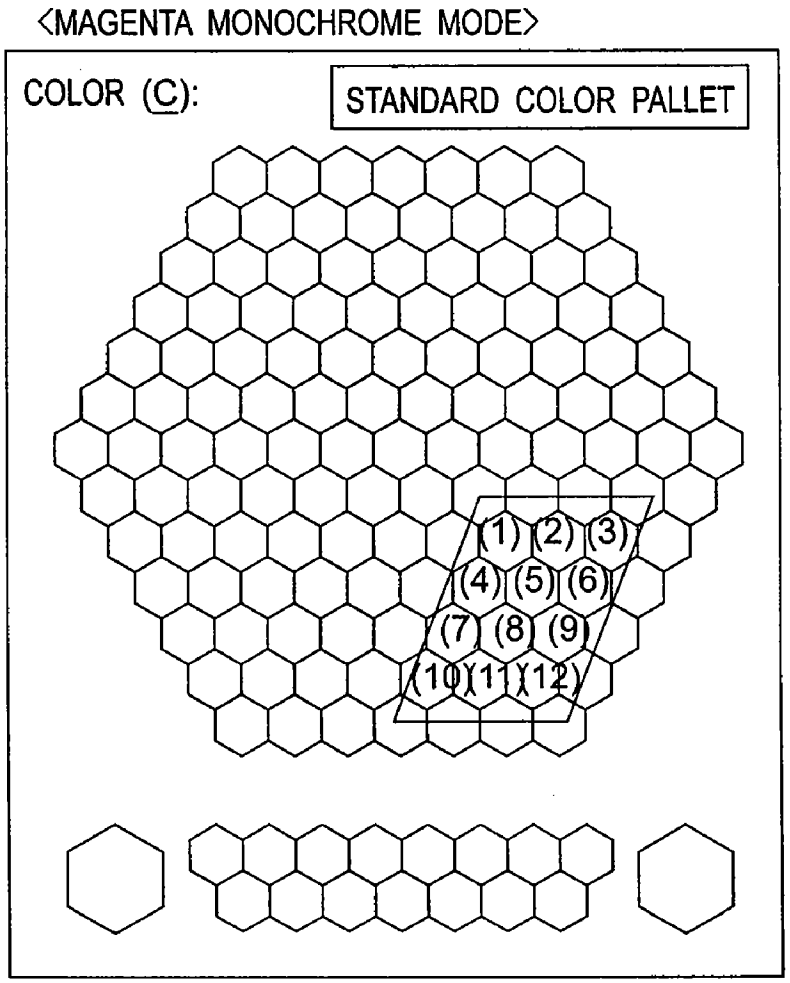
FIG. 10 is a standard color palette for use in Word, Excel, and Power Point, and a table showing CMYK concentration ratio of 12 kinds of similar red colors in which at least 1 color can be omitted from development.

For more specific explanation, FIG. 10 shows a color palette (standard colors) often used in Word, Excel, and PowerPoint as well as a table presenting a concentration ratio of CMYK for 12 kinds of colors (red varieties) seen in (1) to (12) in the color palette. The range of the concentration ratio of these 12 kinds of colors is C:0 to 17%, M:65 to 100%, Y:36 to 100%, and K:0 to 4%. Even when only magenta toner is used in printing to express the difference of these 12 kinds of reddish colors by their shades, the accent color in the outputted image provides mostly the same colors in appearance as those users desire, thereby implementing satisfactory color level. Therefore, when printing in this magenta monochrome mode, compared with the case of printing in normal mode, development with one through three developing colors can be omitted, which makes it possible to suppress toner consumption and to reduce a sound level.

Figure 11A:
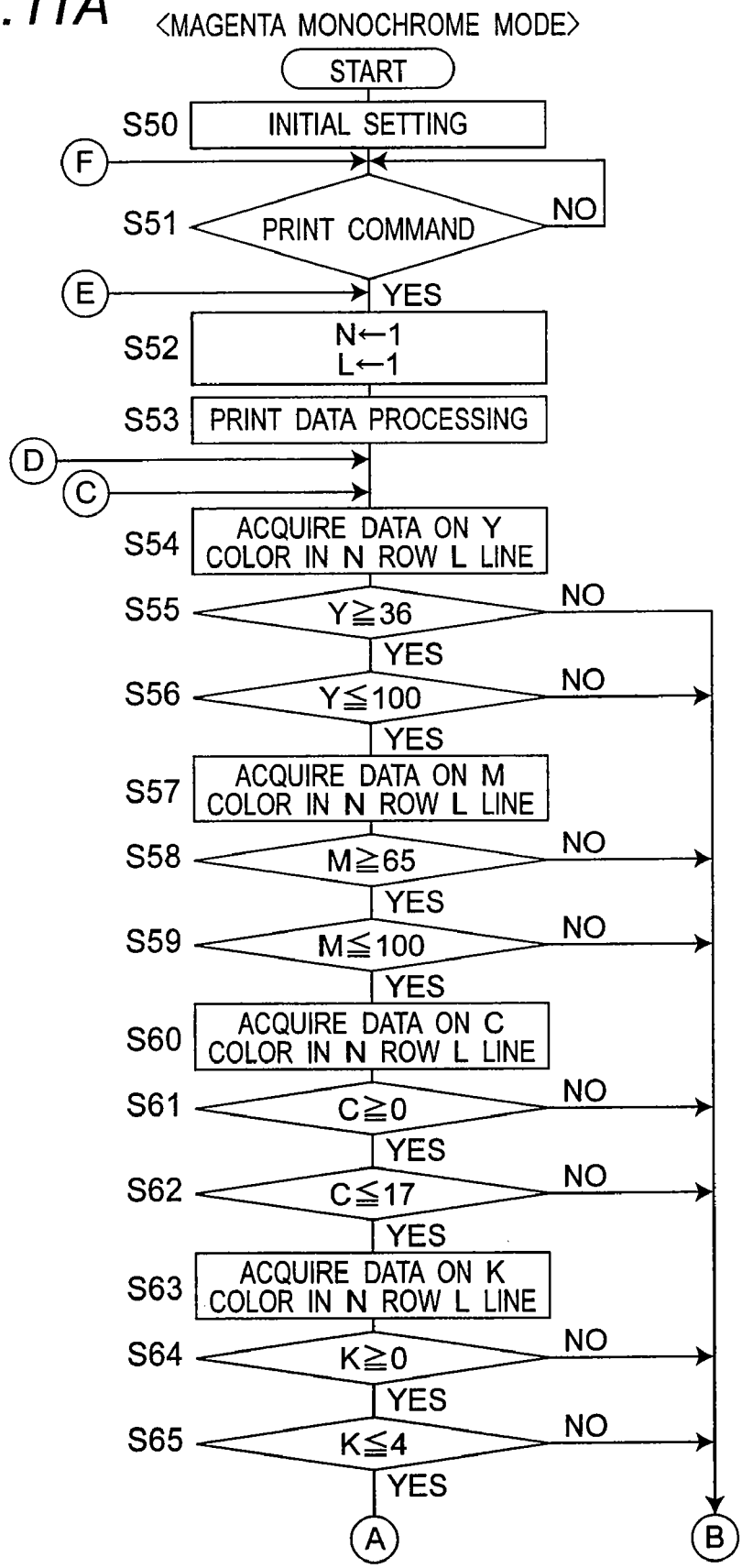
FIG. 11A is a flow chart showing a magenta monochrome mode routine together with FIG. 11B.
Figure 11B:
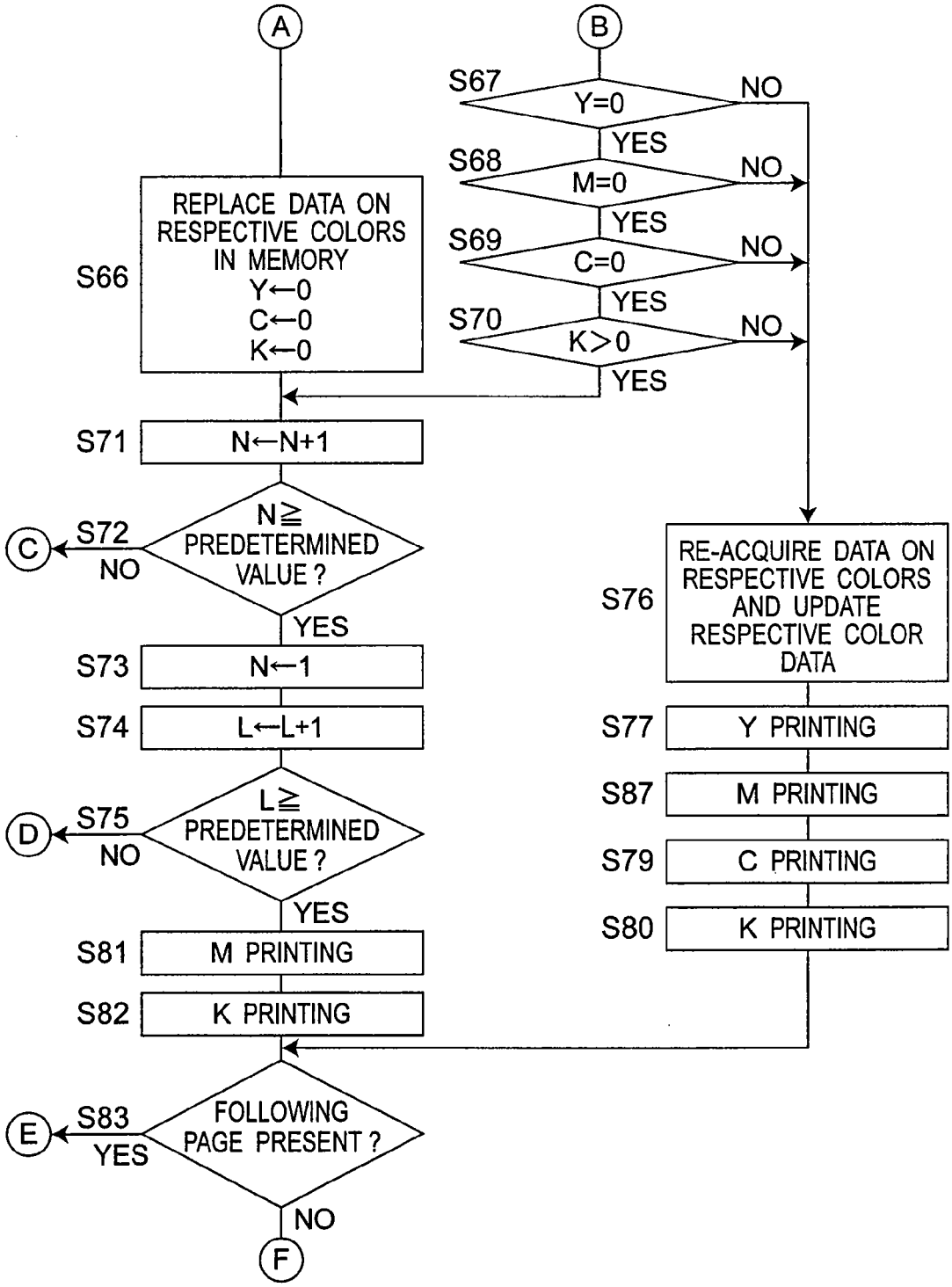
FIG. 11B is a flow chart showing a magenta monochrome mode routine together with FIG. 11A.

A control flow chart of the magenta monochrome mode is shown in FIGS. 11A and 11B. In this control, first, initial setting, such as warm-up operation and image stabilization control, is performed (step S50), and then the apparatus is in standby until a print command is issued (step S51). Upon reception of a print command and image data to be printed from an external devices, such as personal computers, a value N and a value L of N row L line concerning all the dots formed in the whole image formation region in one recording paper are each set to 1 (step S52), and the image data is expanded into respective color data sets corresponding to Y, M, C and K colors and stored in a bit map memory (step S53). In this case, if the image data is a character image, then the data is replaced with the data which includes only K color but not Y, M, and C colors before being stored in the bit map memory.

Next, Y data on Y color of a dot in N row L line (i.e., herein the first row first line) is first acquired from YMCK data obtained by the expansion processing (step S54). It is determined whether or not a concentration ratio of the acquired Y data is in the range from 36% to 100% (step S55, S56), and if it is in this range, the procedure proceeds to the following step S57, whereas if it is less than 36%, then the procedure proceeds to a later-described step S67.

In the case where the Y concentration ratio is in the range, then M data on a dot in the first row first line is acquired (step S57). It is determined whether or not a concentration ratio of the M data is in the range from 65% to 100% (step S58, S59), and if it is in this range, the procedure proceeds to the following step S60, whereas if it is less than 65%, then the procedure proceeds to the later-described step S67.

In the case where the M concentration ratio is in the range, then C data on a dot in the first row first line is acquired (step S60). It is determined whether or not a concentration ratio of the C data is in the range from 0% to 17% (step S61, S62), and if it is in this range, the procedure proceeds to the following step S63, whereas if it is more than 17%, then the procedure proceeds to the later-described step S67.

In the case where the C concentration ratio is in the range, then K data on a dot in the first row first line is acquired (step S63). It is determined whether or not a concentration ratio of the K data is in the range from 0% to 4% (step S64, S65), and if it is in this range, the procedure proceeds to the following step S66, whereas if it is more than 4%, then the procedure proceeds to the later-described step S67.

In the case where the K concentration ratio is in this range, YCK data among respective color data in the memory is replaced with 0 (step S66). That is, this dot is formed based only on M data, and the shade thereof will be expressed according to the M concentration ratio.

Next, the counter value N is increased by only 1 (step S71), and it is determined whether or not the value N is a predetermined value or more (step S72). The predetermined value herein refers to the number of dot rows determined in association with the whole image formation region set up for the recording paper. If it is determined that the value N is smaller than the predetermined value, the processing of the steps S54 to S71 is repeatedly performed on all the dots after the second dot in L line (herein the first line). If it is determined that the value N is the predetermined value or more, then the value N is reset to 1 (step S73), the value L is increased by only 1 (step S74), and it is determined whether or not the value L is a predetermined value or more (step S75). The predetermined value herein refers to the number of dot lines determined in association with the whole image formation region set up for the recording paper. If it is determined that the value L is smaller than the predetermined value, the processing of the steps S54 to S74 is repeatedly performed, by which checking is completed which determines whether or not the YMCK concentration ratio of all the dots in N row L line in an image for one sheet is within the predetermined range. When any one of the YMCK concentration ratios is not within the predetermined range, then it is determined whether or not the Y concentration ratio is 0% (step S67), whether or not the M concentration ratio is 0% (step S68), whether or not the C concentration ratio is 0% (step S69) and whether or not the K concentration ratio is 0% (step S70), respectively, and if all the results are YES, then the procedure returns to the step S71. Then only M printing and K printing are performed (step S81, S82), while Y printing and C printing are omitted.

And after YC printing is completed, it is determined whether or not a following page is present (step S83), and if the following page is present, then the procedure returns to the step S52, whereas if no following page is present, then the procedure returns to the step S51.

If one of the YMCK concentration ratios are not in the predetermined range and any one of the determination results in the step S67 to step S70 is NO, then data on respective colors of YMCK is re-acquired, the respective color data in the memory is updated, and printing with the respective colors of YMCK is performed in sequence based on the updated YMCK data (step S76 to S80). Once YMCK printing is completed, it is determined whether or not a following page is present (step S83), and if the following page is present, the procedure returns to the step S52, whereas if no following page is present, then the procedure returns to the step S51.

Third Embodiment

Description is now given of an image forming apparatus according to a third embodiment of the present invention. Since the second embodiment is similar in structure to the image forming apparatus 1 of the first embodiment except control by the CPU 24, description below will be dedicated to the different control.

The CPU 24 in the image forming apparatus according to the third embodiment is capable of executing a cyan monochrome mode. In the cyan monochrome mode, when an accent color is included in a part of image data for one sheet for example, image formation of an accent color section is performed only with a cyan toner if CM color concentration ratio of the accent color is in the numeric value range of C:57 to 91% and M:34 to 81%.

Figure 12:
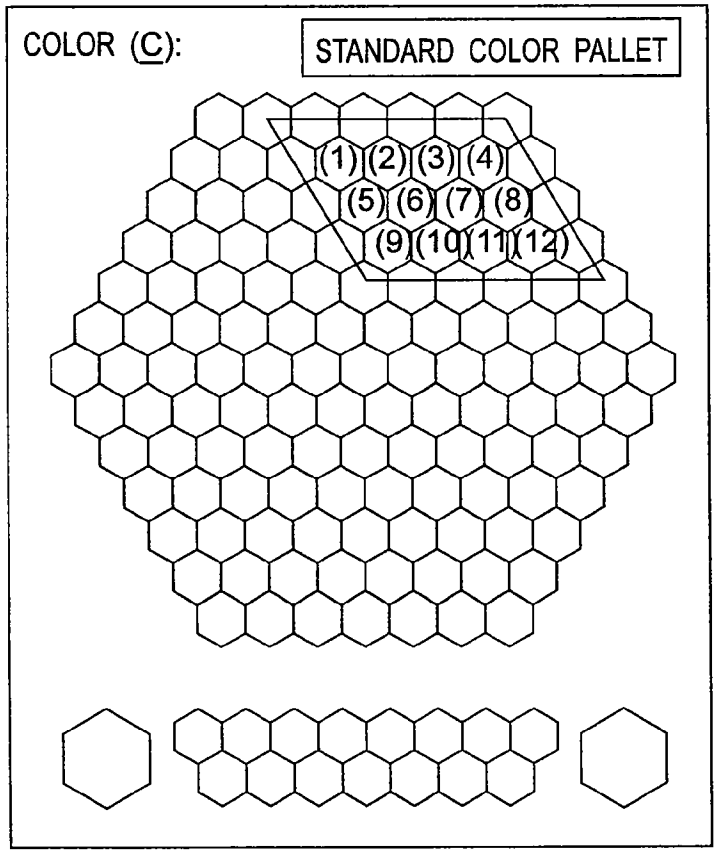
FIG. 12 is a standard color palette for use in Word, Excel, and Power Point, and a table showing CMYK concentration ratio of 12 kinds of similar blue colors in which at least 1 color can be omitted from development.

For more specific explanation, FIG. 12 shows a color palette (standard colors) often used in Word, Excel, and PowerPoint as well as a table presenting a concentration ratio of CMYK for 12 kinds of colors (blue varieties) seen in (1) to (12) in the color palette. The range of the concentration ratio of these 12 kinds of colors is C:57 to 91%, M:34 to 81%, Y:0%, and K:0%. Even when only cyan toner is used in printing to express the difference of these 12 kinds of blue colors by their shades, the accent color in the outputted image provides mostly the same colors in appearance as those users desire, thereby implementing satisfactory color level. Therefore, when printing in this cyan monochrome mode, compared with the case of printing in normal mode, development with one or two developing colors can be omitted, which makes it possible to suppress toner consumption and to reduce a sound level.

Figure 13A:
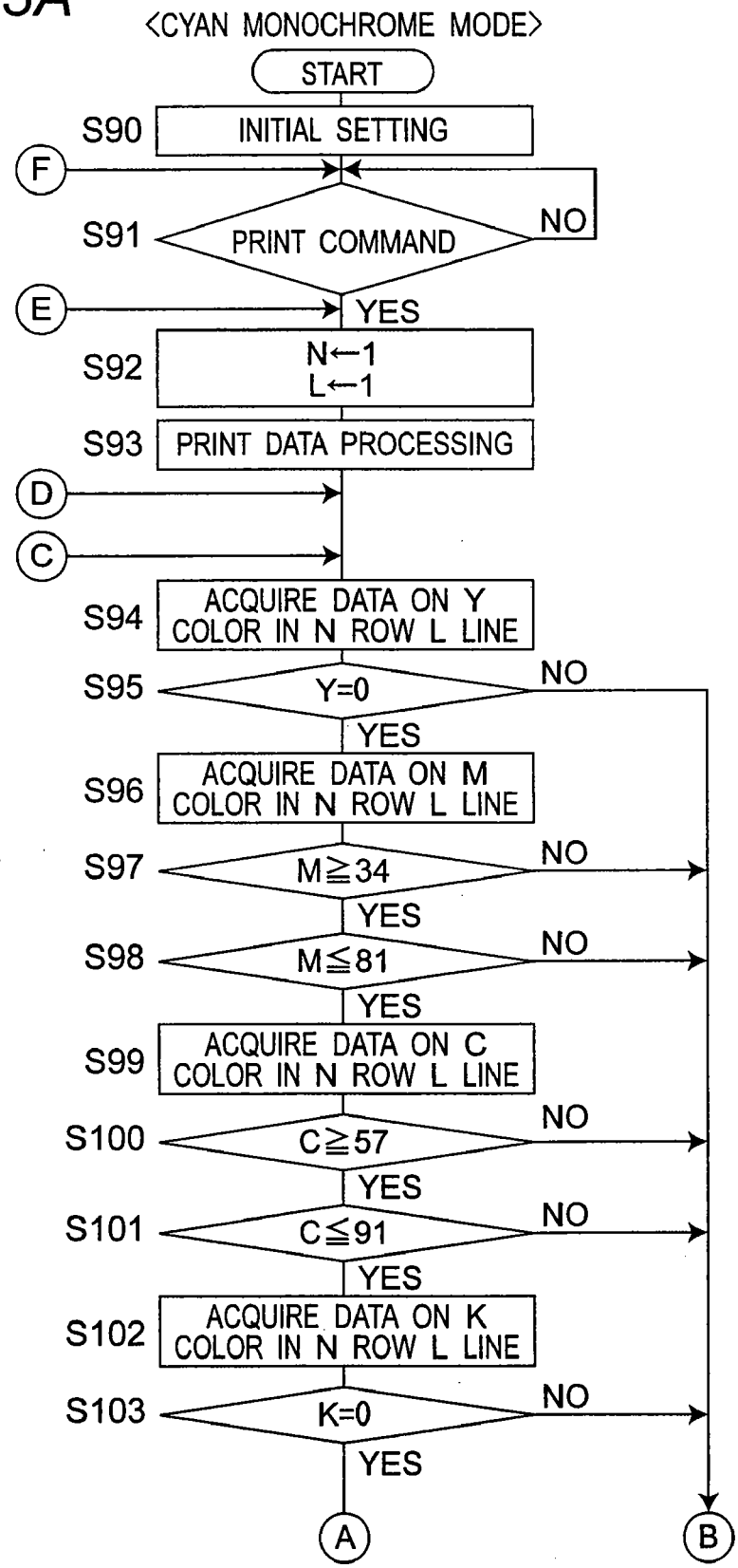
FIG. 13A is a flow chart showing a cyan monochrome mode routine together with FIG. 13B.
Figure 13B:
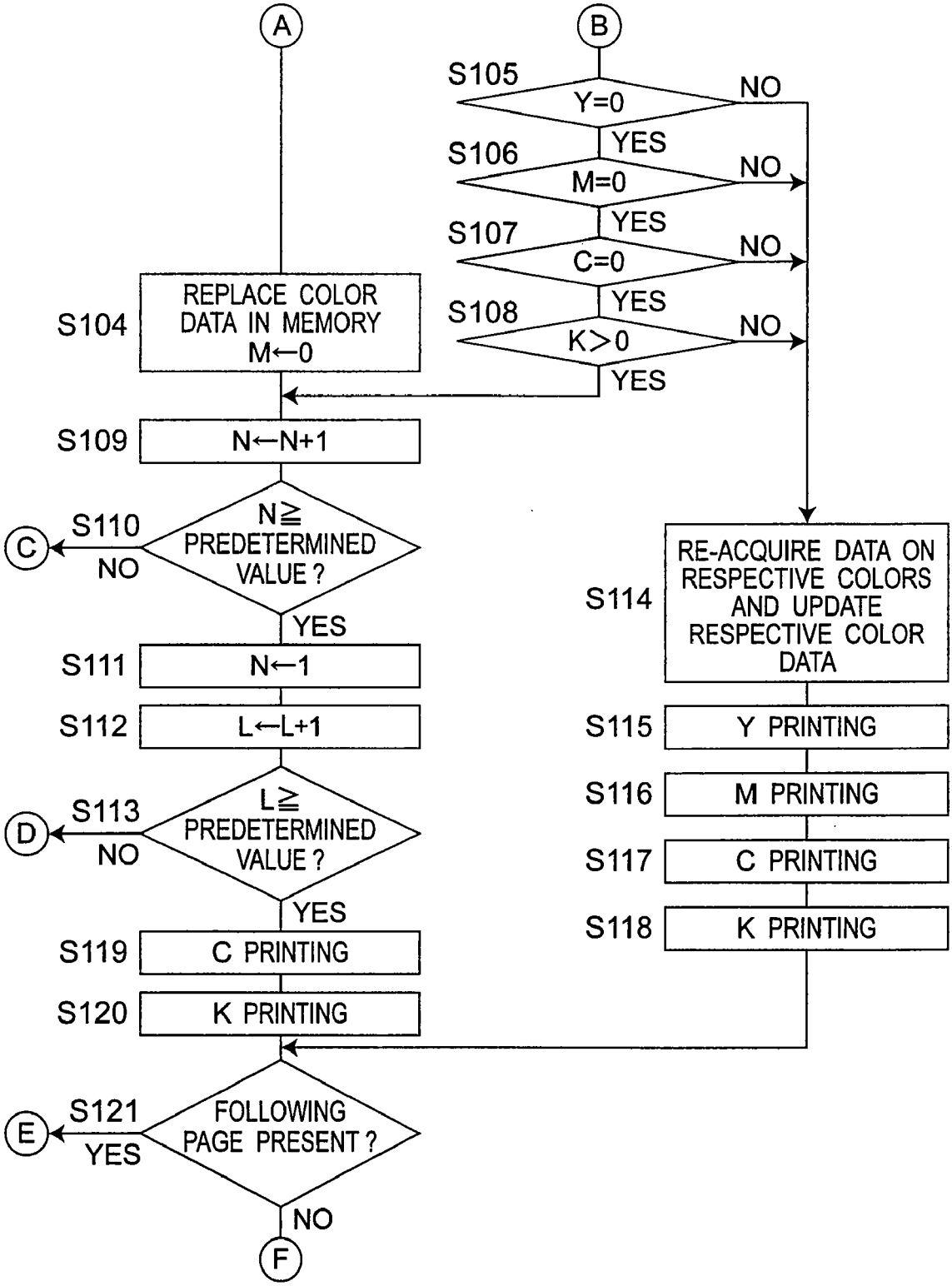
FIG. 13B is a flow chart showing a cyan monochrome mode routine together with FIG. 13A.

A control flow chart of the cyan monochrome mode is shown in FIGS. 13A and 13B. In this control, first, initial setting, such as warm-up operation and image stabilization control, is performed (step S90), and then the apparatus is in standby until a print command is issued (step S91). Upon reception of a print command and image data to be printed from an external devices, such as personal computers, a value N and a value L in N row L line concerning all the dots formed in the whole image formation region in one recording paper are each set to 1 (step S92), and the image data is expanded into respective color data sets corresponding to Y, M, C and K colors and stored in a bit map memory (step S93). In this case, if the image data is a character image, then the data is replaced with the data which includes only K color but not Y, M, and C colors before being stored in the bit map memory.

Next, Y data on Y color of a dot in N row L line (i.e., herein the first row first line) is first acquired from YMCK data obtained by the expansion processing (step S94). It is determined whether or not a concentration ratio of the acquired Y data is 0% (step S95), and if it is 0%, the procedure proceeds to the following step S96, whereas if it is not 0%, then the procedure proceeds to a later-described step S105.

In the case where the Y concentration ratio is 0%, then M data on a dot in the first row first line is acquired (step S96). It is determined whether or not a concentration ratio of the M data is in the range from 34% to 81% (step S97, S98), and if it is in this range, the procedure proceeds to the following step S99, whereas if it is out of this range, then the procedure proceeds to the later-described step S105.

In the case where the M concentration ratio is in the range, then C data on a dot in the first row first line is acquired (step S99). It is determined whether or not a concentration ratio of the C data is in the range from 57% to 91% (step S100, S101), and if it is in this range, the procedure proceeds to the following step S102, whereas if it is out of this range, then the procedure proceeds to the later-described step S105.

In the case where the C concentration ratio is in the range, then K data on a dot in the first row first line is acquired (step S102). It is determined whether or not a concentration ratio of the K data is 0% (step S103), and if it is 0%, the procedure proceeds to the following step S104, whereas if it is not 0%, then the procedure proceeds to the later-described step S105.

In the case where the K concentration ratio is 0%, M data among respective color data in the memory is replaced with 0 (step S104). That is, this dot is formed based only on C data, and the shade thereof will be expressed according to the C concentration ratio.

Next, the counter value N is increased by only 1 (step S109), and it is determined whether or not the value N is a predetermined value or more (step S110). The predetermined value herein refers to the number of dot rows determined in association with the whole image formation region set up for the recording paper. If it is determined that the value N is smaller than the predetermined value, the processing of the steps S94 to S109 is repeatedly performed on all the dots after the second dot in L line (herein the first line). If it is determined that the value N is the predetermined value or more, then the value N is reset to 1 (step S111), the value L is increased by only 1 (step S112), and it is determined whether or not the value L is the predetermined value or more (step S113) The predetermined value herein refers to the number of dot lines determined in association with the whole image formation region set up for the recording paper. If it is determined that the value L is smaller than the predetermined value, the processing of the steps S54 to S74 is repeatedly performed, by which checking of the YMCK concentration ratio of all the dots in N row L line in an image for one sheet is completed. In the steps S95, S97, S98, S100, S101 and S103, when any one of the determination results, that is, the Y concentration ratio is not 0%, the MC concentration ratio is not within the respective predetermined ranges, and the K concentration ratio is not 0%, is positive, then it is respectively determined whether or not the Y concentration ratio is 0% (step S105), whether or not the M concentration ratio is 0% (Step S106), whether or not the C concentration ratio is 0% (step S107), and whether or not the K concentration ratio is 0 (step S108). If any one of the determination results is YES, then the procedure returns to the step S109. And only C printing and K printing are performed (step S119, S120), while Y printing and M printing are omitted.

And after CK printing is completed, it is determined whether or not a following page is present (step S121), and if the following page is present, then the procedure returns to the step S92, whereas if no following page is present, then the procedure returns to the step S91.

If one of the YMCK concentration ratios are not in the predetermined range and any one of the determination results in the steps S95, S97, S98, S100, S101, S103 is NO, then data on respective colors of YMCK is re-acquired, the respective color data in the memory is updated, and printing with the respective colors of YMCK is performed in sequence based on the updated YMCK data (step S115 to S118). Once YMCK printing is completed, it is determined whether or not a following page is present (step S121), and if the following page is present, the procedure returns to the step S92, whereas if no following page is present, then the procedure returns to the step S91.

Fourth Embodiment

Description is now given of an image forming apparatus according to a fourth embodiment of the present invention. Since the second embodiment is similar in structure to the image forming apparatus 1 of the first embodiment except control by the CPU 24, description below will be dedicated to the different control.

The CPU 24 in the image forming apparatus according to the fourth embodiment is capable of executing control in a CM mode which is a combination of the above-mentioned cyan monochrome mode and the magenta monochrome mode. In the CM mode, when an accent color is included in a part of image data for one sheet for example, the same determination as the cyan monochrome mode and the magenta monochrome mode is made in association with the accent color, and then formation of the image including the accent color section is performed with the development of at least one color including Y color being eliminated.

Figure 14A:
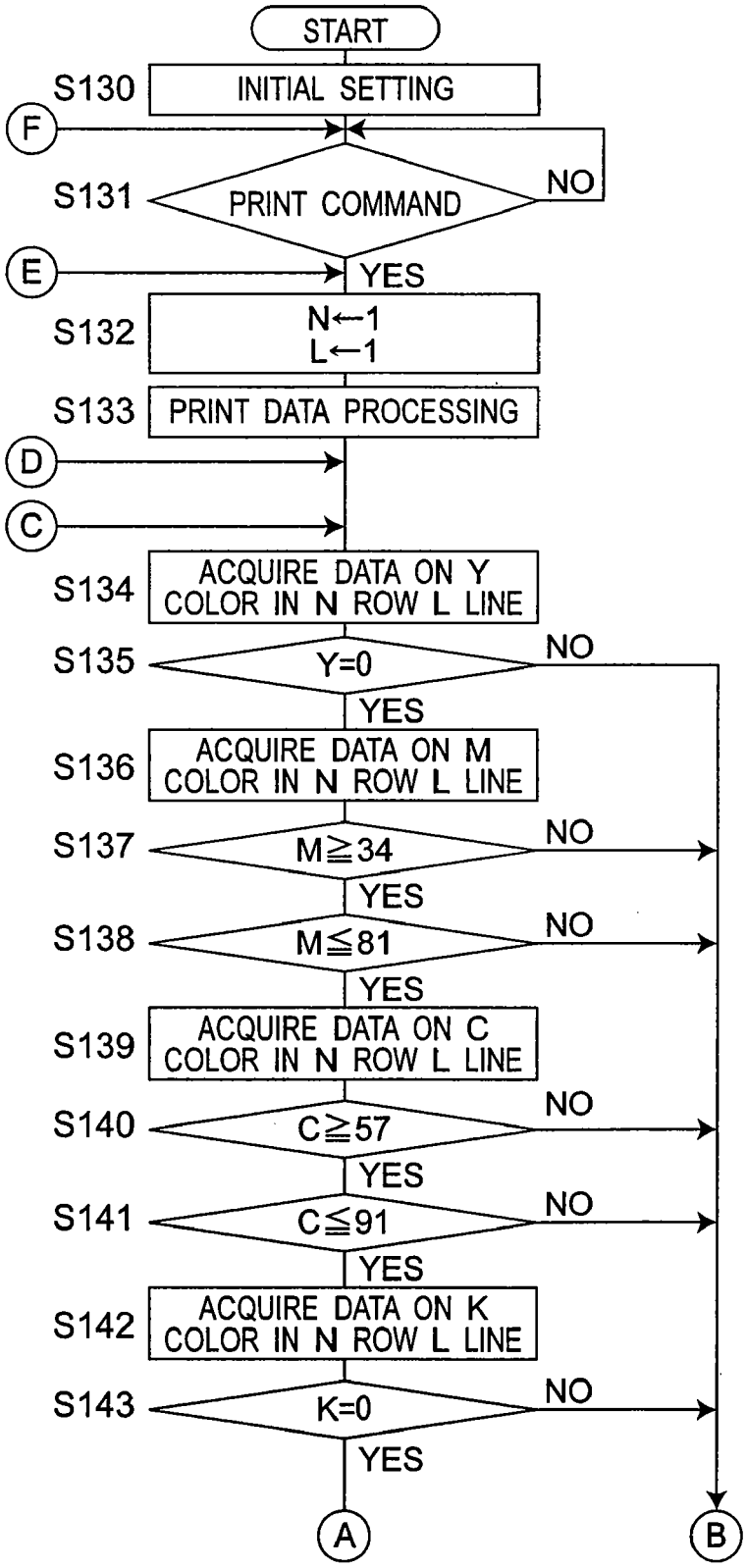
FIG. 14A is a flow chart showing a control mode routine, which is a combination of a magenta monochrome mode and a cyan monochrome mode, together with FIGS. 14B and 14C.
Figure 14B:
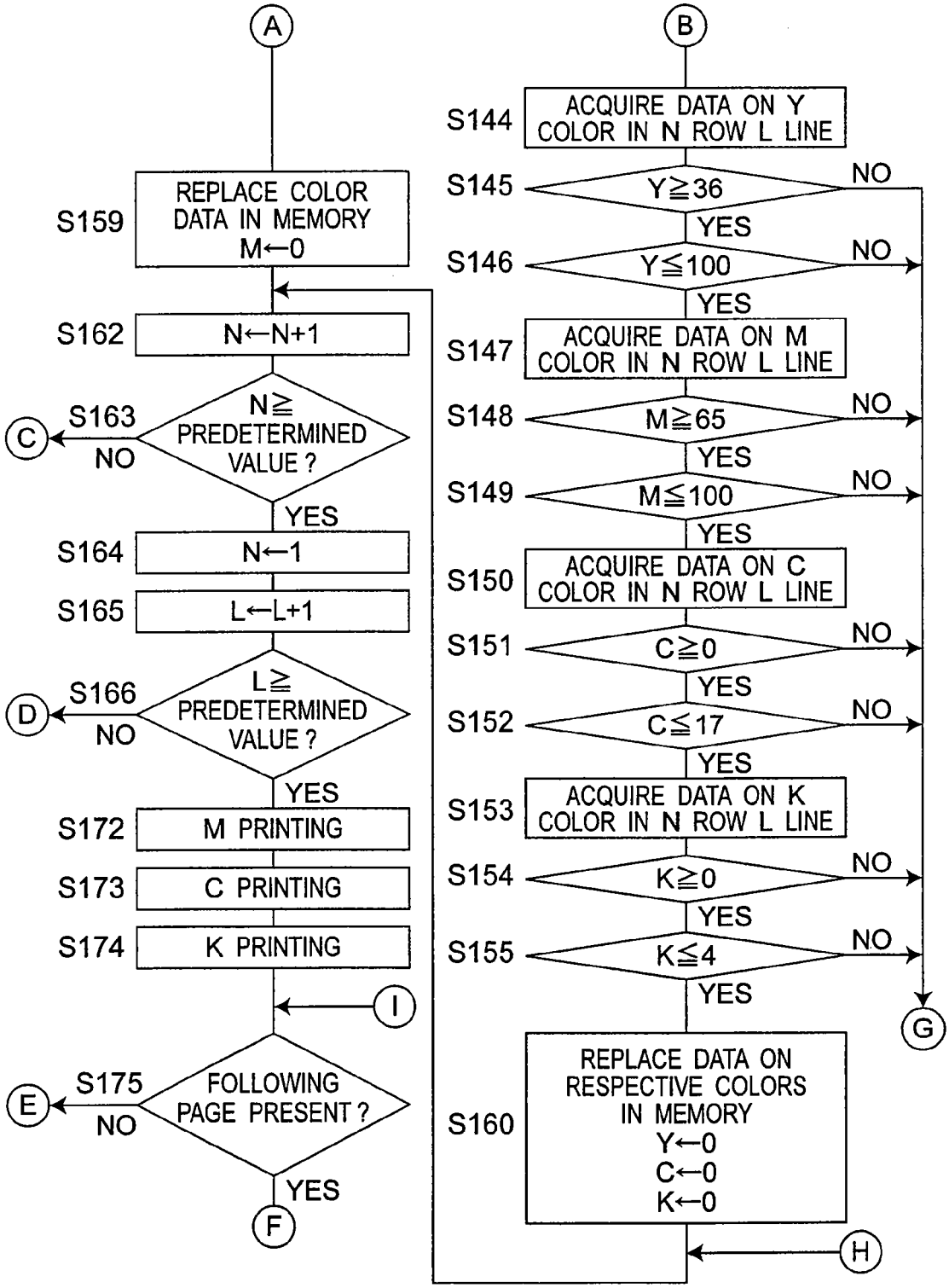
FIG. 14B is a flow chart showing a control mode routine, which is a combination of a magenta monochrome mode and a cyan monochrome mode, together with FIGS. 14A and 14C.
Figure 14C:
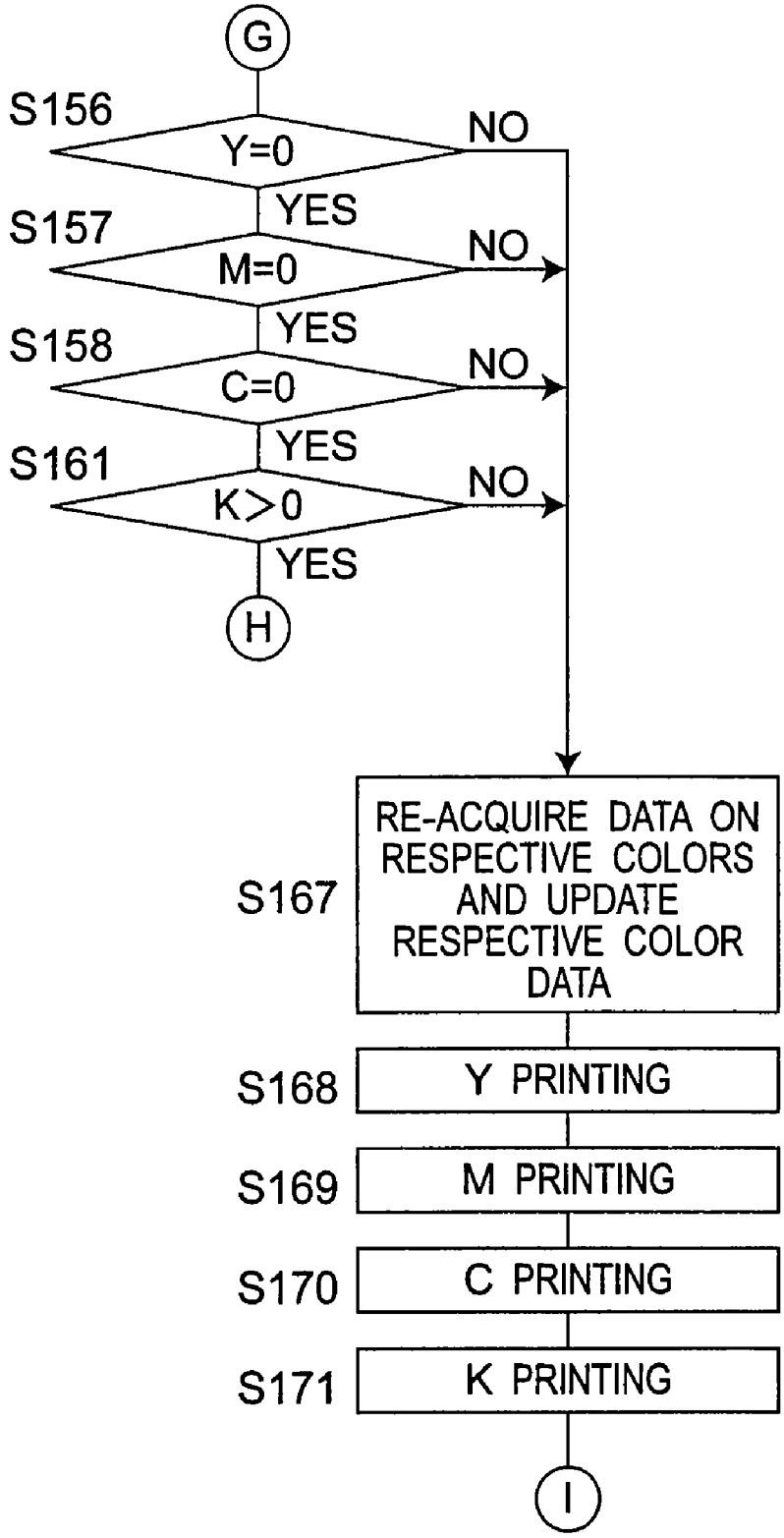
FIG. 14C is a flow chart showing a control mode routine, which is a combination of a magenta monochrome mode and a cyan monochrome mode, together with FIGS. 14A and 14B.

Although the concrete control flow is shown in FIGS. 14A, 14B and 14C, each step in this flow is the same as those of the cyan monochrome mode shown in FIG. 13 mentioned above and the magenta monochrome mode shown in FIG. 11, and therefore description is only given of the association between each step of FIGS. 14A, 14B and 14C and each step of FIGS. 13 and 11 to prevent redundant explanation.

Steps S130 to 133 in FIG. 14A correspond to the steps S90 to 93 in FIG. 13, or the steps S50 to S53 in FIG. 11.

Steps S134 to S166 in FIGS. 14A and 14B correspond to the steps S94 to 113 in FIG. 13. Step S144 to 171 in FIGS. 14B and 14C correspond to the steps S54 to S80 in FIG. 11. Further, steps S172 to S175 in FIG. 14B correspond to the steps S119 to S121 in FIG. 13 in combination with the step S81 in FIG. 11.

Although in each of the embodiments, description has been given of the so-called four cycle-type image forming apparatus, the present invention is applicable to a so-called tandem type image forming apparatus in which four developing devices respectively corresponding to YMCK and including a photoconductor are placed in a fixed position in parallel at specified intervals along a transfer belt.

Although the present invention has been fully described by way of examples with reference to the accompanying drawings, it is to be noted that various changes and modifications will be apparent to those skilled in the art. Therefore, unless otherwise such changes and modifications depart from the spirit and the scope of the present invention, they should be construed as being included therein.

What is claimed is:

1. An image forming apparatus capable of forming a color image on an image carrier with use of developers of a plurality of different developing colors, comprising:

a plurality of developing devices respectively housing the developers of different colors; and a control section for controlling operation of the developing devices based on inputted image data, wherein the control section includes a concentration ratio recognition section for recognizing a concentration ratio of the respective colors for image data of every sheet from the image data, and controls so as to spare at least one color developer among the developers in response to the concentration ratio of respective colors recognized by the concentration ratio recognition section, wherein the control section identifies a highest concentration from the concentration ratio of respective colors recognized by the concentration ratio recognition section, and controls operation of the developing devices so that the developers of at least one other color is not used when it has been recognized that a ratio of the relative concentration to the specified highest concentration is below a predetermined value.

2. The image forming apparatus according to claim 1, wherein the control section includes a determination section for determining non-use of the at least one color developer.

3. The image forming apparatus according to claim 1, comprising a selection section for selecting the relative concentration ratio.

4. The image forming apparatus according to claim 1, wherein the predetermined value is 40%.

5. The image forming apparatus according to claim 1, further comprising a confirmation section for allowing an image formed without using the at least one developing color to be checked before printing.

6. An image forming apparatus capable of forming a color image on an image carrier with use of developers of a plurality of different developing colors, comprising:

a plurality of developing devices respectively housing the developers of different colors; and a control section for controlling operation of the developing devices based on inputted image data, wherein the control section includes a concentration ratio recognition section for recognizing a concentration ratio of the respective colors for image data of every sheet from the image data, and controls so as to spare at least one color developer among the developers in response to the concentration ratio of respective colors recognized by the concentration ratio recognition section, wherein when the respective developing colors include cyan, magenta, yellow and black, and the concentration ratio is 0 to 17% in cyan, 65 to 100% in magenta, 36 to 100% in yellow, and 0 to 4% in black, a portion of the image data corresponding to these conditions is subjected to image formation only with a magenta developer.

7. An image forming apparatus capable of forming a color image on an image carrier with use of developers of a plurality of different developing colors, comprising:

a plurality of developing devices respectively housing the developers of different colors; and a control section for controlling operation of the developing devices based on inputted image data, wherein the control section includes a concentration ratio recognition section for recognizing a concentration ratio of the respective colors for image data of every sheet from the image data, and controls so as to spare at least one color developer among the developers in response to the concentration ratio of respective colors recognized by the concentration ratio recognition section, wherein when the respective developing colors include cyan, magenta, yellow and black, and the concentration ratio is 57 to 91% in cyan and 34 to 81% in magenta, a portion of the image data corresponding to these conditions is subjected to image formation only with a cyan developer.

8. An image forming apparatus capable of forming a color image on an image carrier with use of developers of a plurality of different developing colors and transferring the formed color image so as to form the color image on a sheet, comprising:

a plurality of developing devices respectively housing the developers of different colors;

a calculation section for calculating, based on inputted image data, a concentration ratio of the respective colors for every dot to be formed on an image; and a control section for controlling operation of the developing devices so that when a ratio of a certain color calculated by the calculation section for all the dots to be formed for one sheet is lower than a predetermined value, the developing device of the color is not used, wherein the control section identifies a highest concentration from the concentration ratio of respective colors calculated by the calculation section, and controls operation of the developing devices so that the developers of at least one other color whose relative concentration ratio to the identified highest concentration is below a predetermined value.

* * * * *

UNITED STATES PATENT AND TRADEMARK OFFICE

CERTIFICATE OF CORRECTION

PATENT NO. : 8,285,160 B2
APPLICATION NO. : 12/131656
DATED : October 9, 2012
INVENTOR(S) : Takayuki Ito et al.

It is certified that error appears in the above-identified patent and that said Letters Patent is hereby corrected as shown below:

Title page, item [54] and column 1, line number 2, in the Title:

Replace "CONCENTERATION" with --CONCENTRATION--.

Title page, in the References Cited, column 2:

Under Other Publications, replace "Machine English Translation of of patent JP09-163169 published Jun. 20, 1997.*" with --Machine English Translation of patent JP09-163169 published Jun. 20, 1997.*--.

Signed and Sealed this
Fourth Day of December, 2012

David J. Kappos

David J. Kappos
*Director of the United States Patent and Trademark Office*